US006443652B1

(12) United States Patent
Houck et al.

(10) Patent No.: US 6,443,652 B1
(45) Date of Patent: Sep. 3, 2002

(54) AGGREGATE CHAMBER LEACH LINES FOR LEACHING EFFLUENT AND ASSOCIATED METHOD

(76) Inventors: Michael H. Houck, P.O. Box 478, Dubois, WY (US) 82513; Thomas K. Weaver, 123 Buena Vista, Brevard, NC (US) 28712

( * ) Notice: Subject to any disclaimer, the term of this patent is extended or adjusted under 35 U.S.C. 154(b) by 0 days.

(21) Appl. No.: 09/605,813

(22) Filed: Jun. 28, 2000

Related U.S. Application Data

(60) Provisional application No. 60/141,507, filed on Jun. 28, 1999.

(51) Int. Cl.[7] ..... E02B 11/00

(52) U.S. Cl. ..... 405/46; 405/45; 405/53; 210/170; 210/747

(58) Field of Search ..... 405/36, 51, 50, 405/49, 78, 47, 46, 45, 44, 43, 42, 39, 52, 53, 55; 210/170, 747

(56) References Cited

U.S. PATENT DOCUMENTS

| | | | | | |
|---|---|---|---|---|---|
| 1,518,014 | A | * | 12/1924 | Steen | 405/47 |
| 2,518,292 | A | * | 8/1950 | De Anglis | 405/47 |
| 2,768,949 | A | * | 10/1956 | Hewey | 210/747 |
| 3,220,194 | A | * | 11/1965 | Lienard | 405/45 |
| 3,343,567 | A | * | 9/1967 | Mulligan et al. | 138/119 |
| 3,441,140 | A | * | 4/1969 | Thurber | 210/170 |
| 3,645,100 | A | * | 2/1972 | La Monica | 405/46 |
| 3,820,341 | A | * | 6/1974 | Richard et al. | 405/46 |
| 3,919,848 | A | * | 11/1975 | Sullivan | 405/43 |
| 4,142,325 | A | * | 3/1979 | Greenbaum | 405/45 |
| 4,192,628 | A | * | 3/1980 | Gorman | 405/45 |
| 4,360,042 | A | * | 11/1982 | Fouss et al. | 405/49 |
| 4,588,325 | A | * | 5/1986 | Seefert | 405/46 |
| 4,824,287 | A | * | 4/1989 | Tracy | 405/36 |
| 5,015,123 | A | * | 5/1991 | Houck et al. | 405/45 |
| 5,017,042 | A | * | 5/1991 | Minor et al. | 405/50 |
| 5,100,258 | A | * | 3/1992 | Van Wagoner | 405/45 |
| 5,378,357 | A | * | 1/1995 | Houck et al. | 405/45 |
| 5,556,231 | A | * | 9/1996 | Sidaway et al. | 405/48 |
| 5,639,364 | A | * | 6/1997 | Houck et al. | 405/45 |
| 5,921,711 | A | * | 7/1999 | Sipaila | 405/45 |
| 5,997,735 | A | * | 12/1999 | Gorton | 405/43 |
| 6,267,882 | B1 | * | 7/2001 | Houck et al. | 405/43 |
| 6,270,661 | B1 | * | 8/2001 | Jowett | 405/46 |

FOREIGN PATENT DOCUMENTS

| | | | |
|---|---|---|---|
| JP | 57194090 | * | 11/1982 |

* cited by examiner

*Primary Examiner*—Heather Shackelford
*Assistant Examiner*—Frederick L. Lagman
(74) *Attorney, Agent, or Firm*—Allen, Dyer, Doppelt, Milbrath & Gilchrist, P.A

(57) ABSTRACT

An aggregate chamber for leaching effluent comprises a chamber cavity, at least one panel positioned along a periphery of the chamber cavity, and aggregate for filtering effluent. The chamber unit may include a plurality of foldingly connected panels, and at least one conduit for delivering effluent. A leach line comprises a trench excavated in a leach field, and a plurality of chamber units having a cavity, at least one panel, and aggregate for filtering effluent. A leach field comprises a source of effluent, a plurality of trenches excavated in the soil adjacent the source of effluent, and a plurality of leach lines positioned in the plurality of trenches in fluid connection with the source of effluent, each leach line having at least one chamber unit comprising a cavity, at least one panel, and an aggregate for filtering effluent. A method aspect of the invention includes leaching effluent by conducting effluent from a source to a chamber, filtering the effluent through an aggregate, and leaching the effluent into the leach field. A method of constructing a leach field comprises excavating a plurality of trenches, positioning a plurality of panels in the trenches to define a plurality of walls for chamber leach lines, positioning aggregate adjacent the plurality of panels for substantially filtering the effluent leaching into the field, and connecting the aggregate chamber leach lines to a source of effluent.

42 Claims, 26 Drawing Sheets

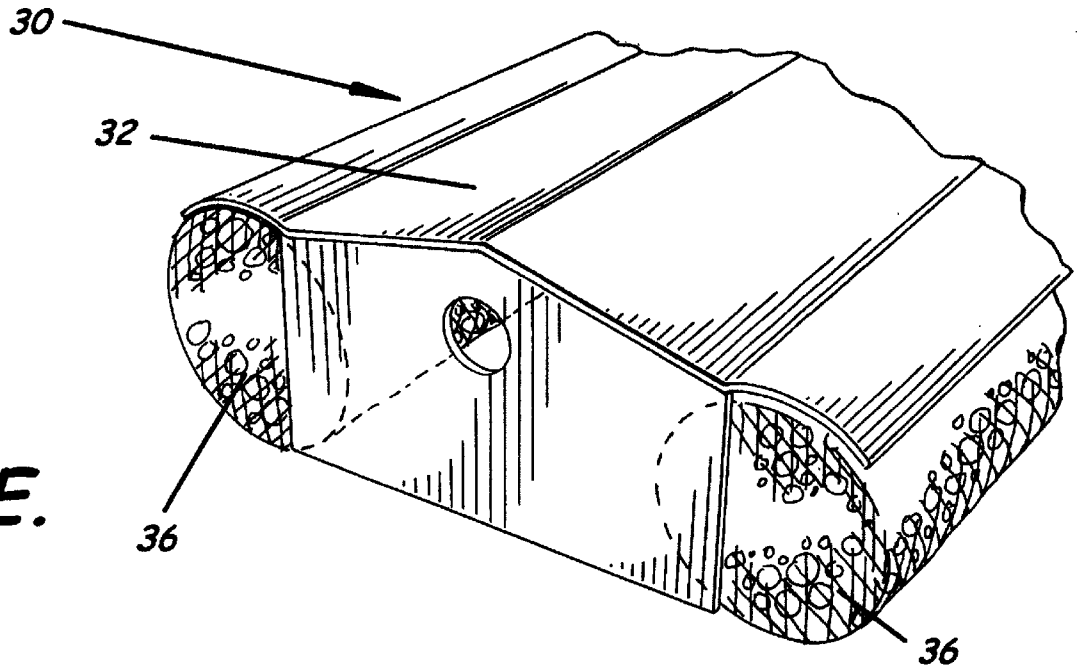
FIG. 5.
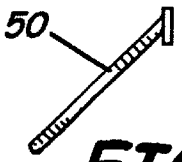
FIG. 5E.
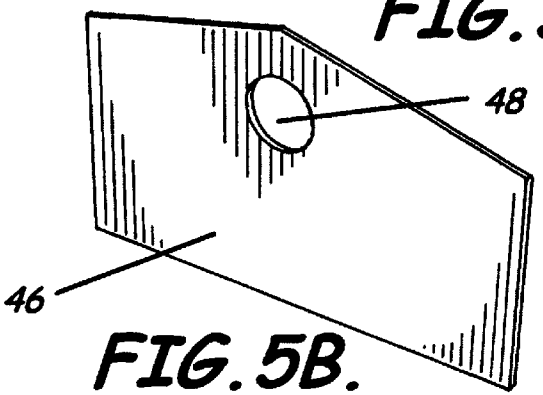
FIG. 5A.
FIG. 5B.
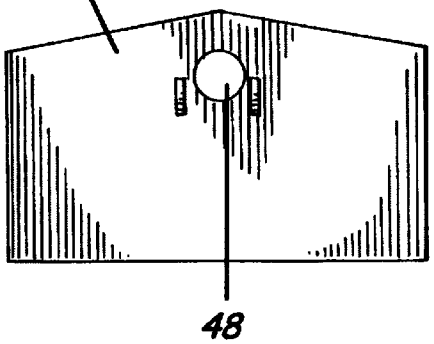
FIG. 5C.
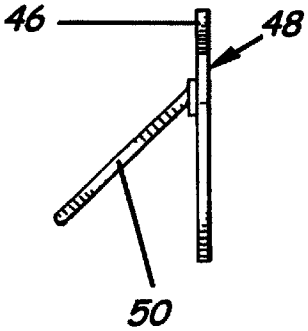
FIG. 5D.

36
54
32
54'
36
38

36
48
46
36

36
54
52
32'
36
38

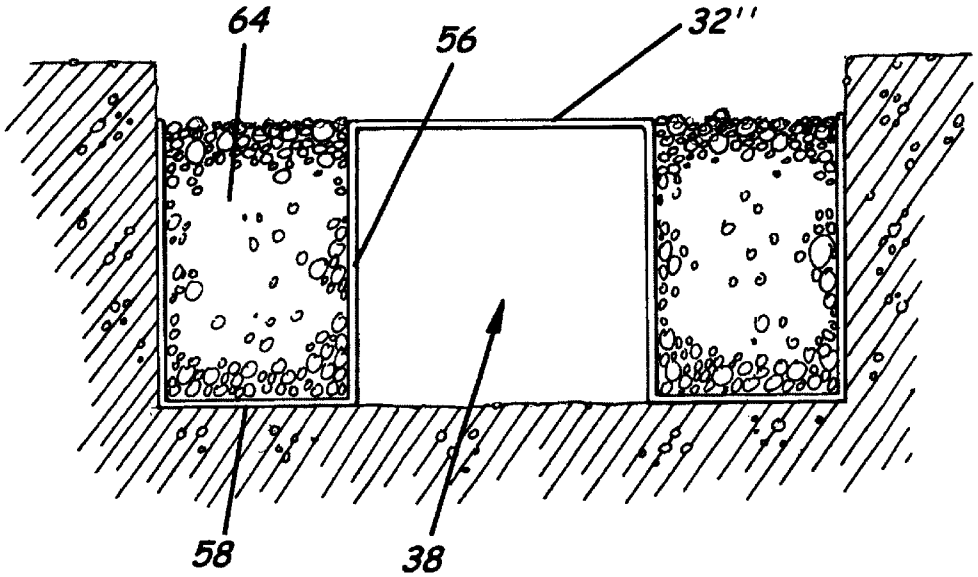
FIG. 7B.
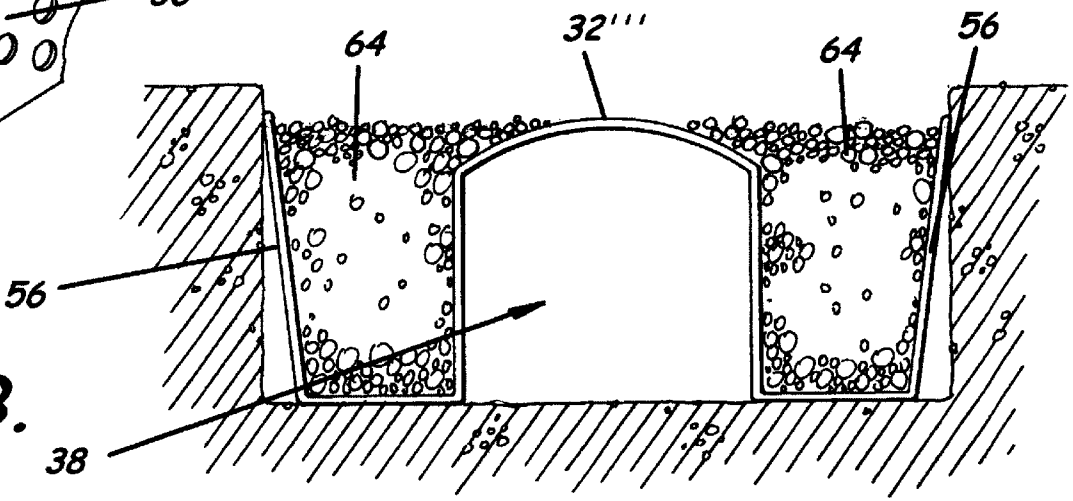
FIG. 8B.
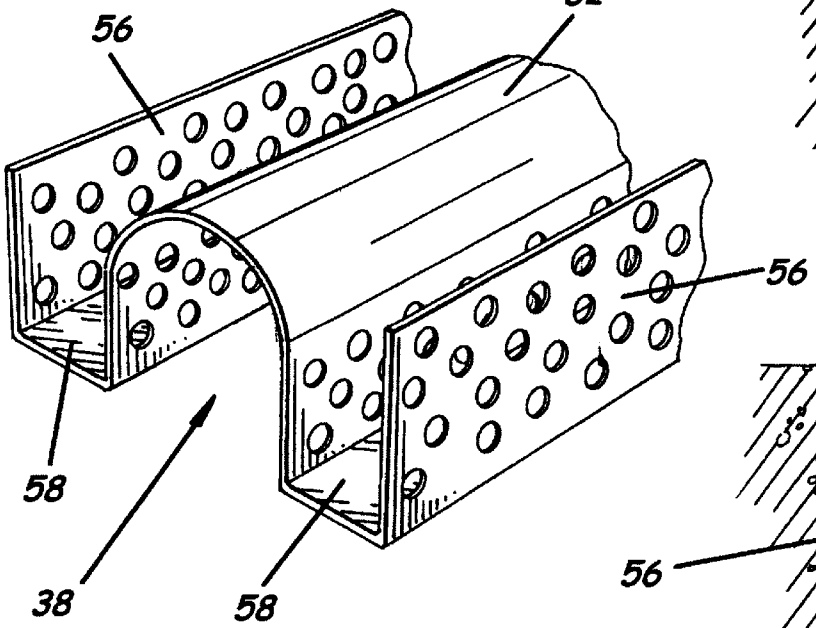
FIG. 8.
FIG. 8A.

FIG. 10.
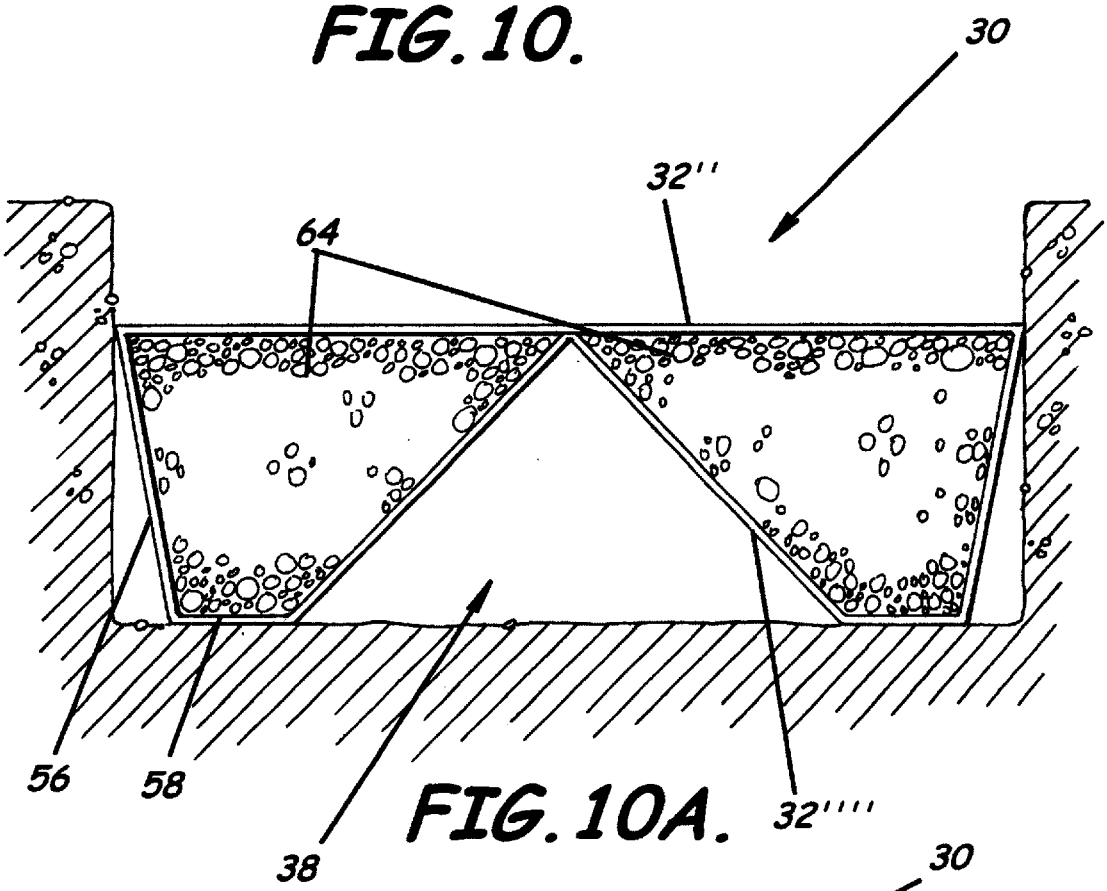
FIG. 10A.
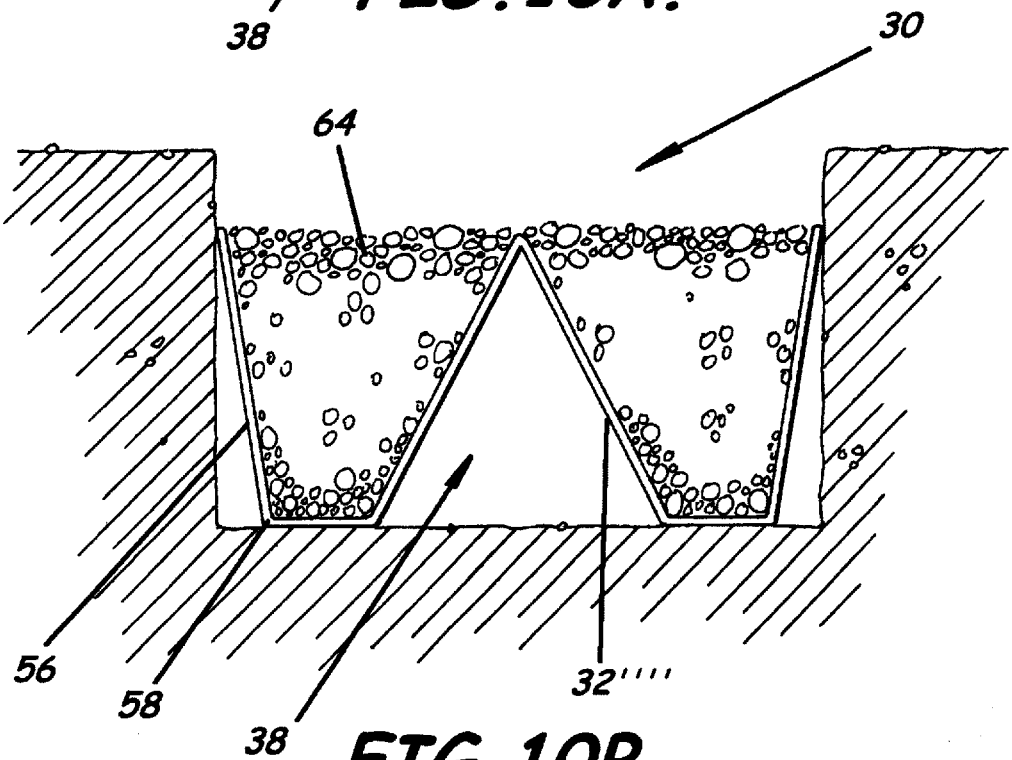
FIG. 10B.

30
32'''
66
56
56
58
38
56

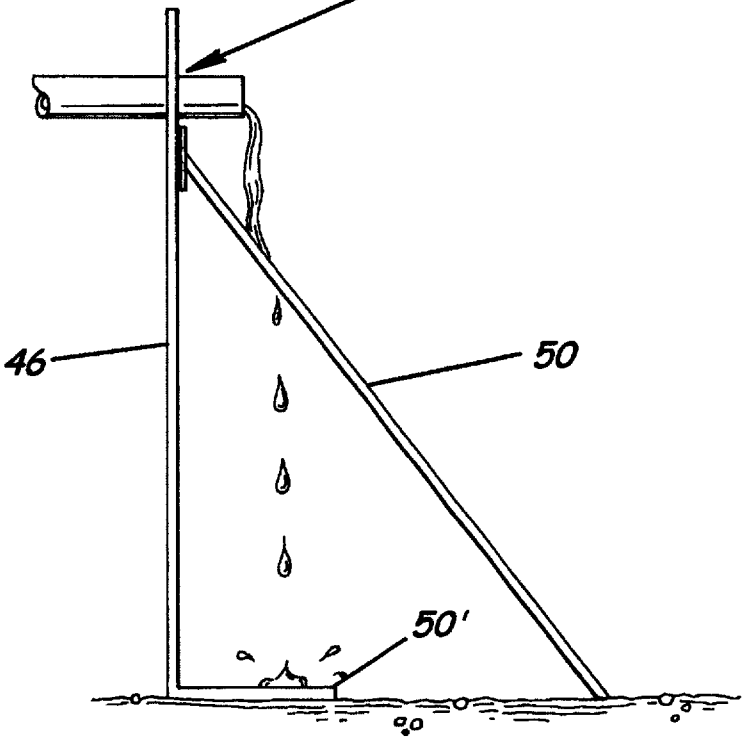
FIG. 23.
FIG. 23B.
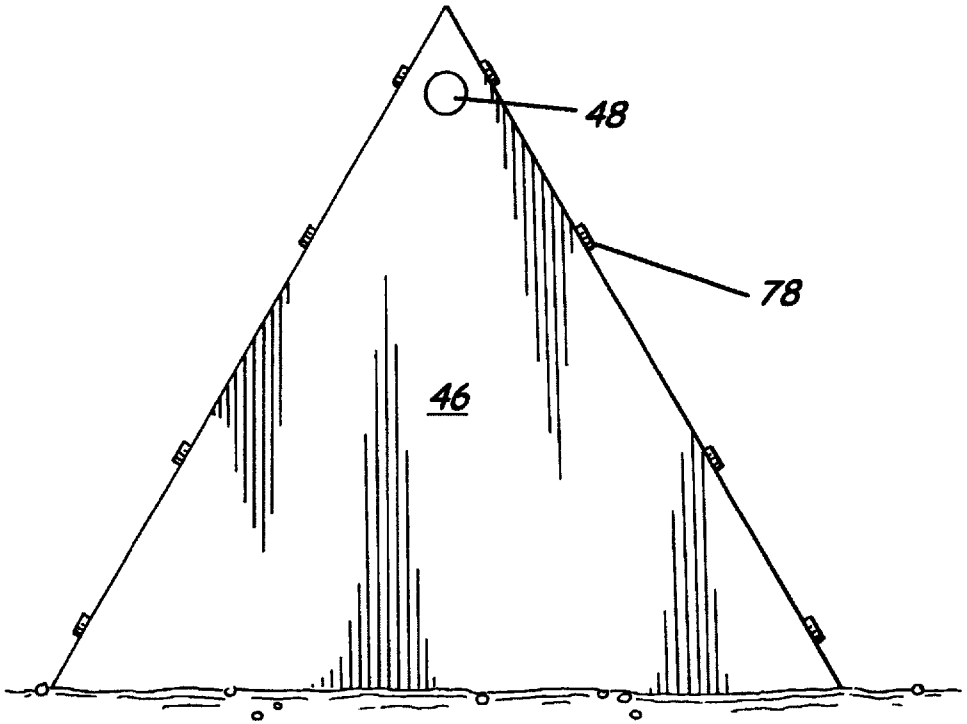
FIG. 23A.

AGGREGATE CHAMBER LEACH LINES FOR LEACHING EFFLUENT AND ASSOCIATED METHOD

RELATED APPLICATIONS

This application claims priority from provisional patent application Serial No. 60/141,507 which was filed on Jun. 28, 1999, and which is incorporated herein by reference in its entirety.

FIELD OF THE INVENTION

The present invention relates to drainage field systems and, more particularly, to chamber leach line systems which are manufactured and ready to install in a drainage field for wastewater and stormwater.

BACKGROUND OF THE INVENTION

Residential septic tank systems are used where municipal sewerage systems are not available. Wastewater from the home flows into the septic tank for on-site treatment through the biological activity of microorganisms, and leachate passing from the septic tank flows into a drain field from which it percolates into the ground. Drain fields of standard construction include a network of trenches dug in the ground, with a layer of loose aggregate material, such as gravel, placed in the bottom of the trench. A pipe is connected to the outlet of the septic tank and also connected to perforated pipes which are laid into the network of trenches. The space between the perforated pipe and the ground, which is filled by the loose aggregate, essentially becomes a drainage cavity for receiving leachate discharged through the perforations in the pipe. In normal operation, the septic tank effluent flows out into the network of perforated pipes and slowly percolates through the aggregate in the bottom of the trenches and down through the soil. Standard systems such as the one described are not well adapted for handling peak flows, such as might be experienced when several high volume water consumption activities are occurring simultaneously in the house, or when the leaching field is intended to handle stormwater.

Chamber-type drainage systems are able to handle larger flows and have become more widely used as an improvement over standard systems. A chamber system includes a void space into which excess effluent can flow for holding prior to percolation through the ground. The chambers are generally buried in a network of trenches as part of the leach field system. Chamber systems thus provide the advantage of being able to accommodate larger peak flows of effluent than standard systems. Examples of such chamber systems include U.S. Pat. No. 5,511,903 to Nichols et al., U.S. Pat. No. 5,498,104 to Gray, U.S. Pat. No. 5,017,041 to Nichols, and U.S. Pat. No. 4,759,661 to Nichols et al. Even though chamber systems accommodate larger peak flows, however, leaching chambers systems have not achieved the soil interface characteristics offered by conventional trench and gravel installations.

SUMMARY OF THE INVENTION

With the foregoing in mind, the present invention advantageously provides a chamber unit for leaching effluent in a leach field. An embodiment of the chamber unit comprises a chamber cavity for therein receiving effluent for leaching, at least one panel positioned to define a periphery of the chamber cavity, and aggregate comprising a plurality of bodies positioned adjacent the panel for filtering effluent.

The aggregate may be conventional gravel but is preferably a lightweight particulate material such as expanded polystyrene, polyethylene, polyurethane, polypropylene, and rubber chips such as obtained from ground up tires.

In a preferred embodiment of the invention chamber units are fluidly connected together and to a source of effluent to thereby form a chamber leach line. A sufficient number of leach lines is then positioned in trenches excavated in soil to form a leach field. A chamber unit may be connected to a source of effluent so as to receive effluent directly into the chamber cavity. The soil floor of the excavated trench generally forms the lower periphery of the chamber leach line, through which effluent filters into the soil. It is known that the soil surface through which effluent filters will generally develop a film of microbial growth, a biofilm which may eventually clog the soil surface. Advantageously, aggregate may be positioned relative to the chamber unit cavity so as to filter effluent flowing out of the chamber cavity and into the surrounding soil of the trench. The aggregate material provides a greatly increased surface area for biofilm accumulation, which in turn serves for enhancing microbial treatment of the effluent to thereby reduce nutrients leaching into the soil.

A further embodiment positions aggregate along side peripheries of the chamber cavity, so that effluent is filtered through the aggregate as it flows laterally out of the chamber cavity and into the surrounding soil. Aggregate, however, may also be positioned along a lower periphery of the chamber cavity to provide filtration for effluent flowing downwardly from the cavity into the soil of the trench. Aggregate positioned along side peripheries of the chamber cavity is preferably contained in a sleeve of water permeable material, and may be thus prefabricated prior to field installation. Under normal flow conditions, effluent generally flows into the surrounding soil through the lower periphery of the chamber cavity. Under excess flow conditions, however, where the soil underlying the chamber cavity is unable to absorb the volume, effluent will also flow laterally into the surrounding soil through side peripheries of the chamber cavity, thereby being filtered through the aggregate.

In another embodiment, side peripheries of the chamber cavity are defined by perforated conduit connected to a source of effluent so that the effluent passes through the conduit and trickles into the chamber cavity from the perforated conduit. This embodiment may have aggregate positioned adjacent the perforated conduit so as to filter effluent trickling from the conduit into the chamber cavity.

In yet another embodiment the chamber unit includes a plurality of foldingly connected, substantially flat panels positioned to define peripheries of a chamber cavity when properly positioned unfolded in a trench excavated in a leach field. This embodiment includes at least one conduit positioned to deliver effluent to the chamber cavity. Prefabrication of the chamber unit as a plurality of connected substantially flat panels which advantageously fold along the connections for allowing easy storage and transportation of the units in a folded position. Additionally, the individual units are easily set up by unfolding and properly positioning within trenches to thereby form chamber leach lines when connected together.

The invention further includes a leach field for leaching effluent into soil. The leach field comprises a source of effluent, a plurality of trenches excavated in soil adjacent the source of effluent, and a plurality of leach lines positioned in the plurality of trenches in fluid connection with the source of effluent for distributing the effluent by leaching into the soil. Each leach line of the plurality includes at least one chamber unit comprising a cavity for therein receiving the effluent for leaching, at least one panel positioned along a periphery of the cavity, and an aggregate comprising a plurality of bodies positioned adjacent the panel for filtering effluent.

A method aspect of the invention includes leaching effluent into a leach field by conducting effluent from a source of effluent to a chamber for holding prior to leaching, filtering the effluent through an aggregate as the effluent flows from the chamber, and leaching the effluent into the leach field after filtering through the aggregate. A further embodiment of the method comprises conducting effluent from a source of effluent, filtering the effluent while the effluent flows into a chamber for holding prior to leaching, and leaching the effluent from the chamber into the leach field.

The invention additionally includes a method of constructing a leach field for effluent. This method comprises excavating a plurality of trenches in soil, positioning a plurality of panels in the trenches so as to define a plurality of walls for chamber leach lines, positioning aggregate adjacent the plurality of panels for substantially filtering the effluent leaching into the field, and connecting the aggregate chamber leach lines to a source of effluent.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 1 shows a front perspective view of a chamber aggregate drain line system according to an embodiment of the present invention, wherein

FIG. 5*a* shows chamber unit of the present invention having an end plate of FIG. 5*b* installed to close off the chamber, detail of the end plate shown in FIG. 5*c* and a side view of the end plate with splash guard in position is shown in FIG. 5*d;*

FIG. 7 shows a front perspective view of an embodiment of a chamber aggregate drain line system comprising foldingly connected panels, wherein FIG. 7*a* shows an end panel for same, and FIG. 7*b* shows the chamber of FIG. 7 positioned in a leach field trench;

FIG. 8*a* is a front perspective view of the chamber of the present invention comprising foldingly connected panels wherein the chamber cavity has an arched top, and FIG. 8*b* shows the chamber of FIG. 8*a* positioned in a leach field trench;

FIG. 9*a* is a front perspective view of a chamber aggregate drain line system having generally a cross section shaped as a "W" and comprising foldingly connected panels, wherein FIG. 9*b* shows a mesh bag for containing aggregate for use with the chamber of FIG. 9*a*, wherein

FIG. 10*a* shows a front elevation of "W" shaped chamber aggregate drain line formed from foldingly connected panels and placed in a trench, wherein FIG. 10*b* shows the chamber of FIG. 10*a* adjusted to a narrower trench;

FIG. 11*a* is a front perspective view of a dual chamber aggregate drain line system comprising connected flat panels, wherein FIG. 11*b* shows the dual chamber unit positioned in a leach field trench.

FIG. 23*a* is a front elevation of an end panel for a triangular chamber and FIG. 23*b* is a side view showing detail of drain pipe connecting to the end panel of same.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers are used to refer to like elements throughout the description of the invention.

The invention relates to drainage field systems and, more particularly, to chamber leach line systems which are manufactured and ready to install in a drainage field for wastewater and stormwater. The invention is particularly well suited for treatment of effluent from a residential septic tank.

The invention may also be employed for drain fields for disposal of stormwater, industrial wastewater, and similar applications.

Effluent drainage fields typically comprise a network of trenches dug into the soil of the drainage field adjacent a source of effluent. Leach lines are connected to the source of effluent and disposed in the network of trenches for leaching effluent into the soil. Once the leach lines are set in place, the trenches are covered with soil. This invention is preferably to be used for installation in trenches dimensioned according to the health requirements of the appropriate jurisdictional agency; however, trenches having an approximate width of from one to four feet are commonly known in the art and would be suitable for the present invention.

FIGS. 1 through 26 illustrate various features and embodiments of the invention, which may include a prefabricated aggregate drainage line unit incorporating a chamber cavity for handling septic tank leachate and other types of effluents, such as industrial wastewater and stormwater runoff. An advantageous aspect of the invention includes a chamber leach line unit which comprises substantially flat panels assembled together on the job site for forming the chamber leach line. The substantially flat panels allow for easy storage of the components, and also facilitate transportation of the components to the field. Embodiments of the invention also provide novel flow characteristics wherein effluent flows laterally from a chamber cavity and through an aggregate material for biological treatment of the effluent. All panels and structural members used in the invention are preferably manufactured of a material such as high impact plastic so that the chamber leach lines will have a long operational life. In addition, the leach lines should be of sufficient structural strength to support the soil overlying the leach field trenches, and for example to withstand the weight of vehicles which may drive over the leach field.

Figure 1:
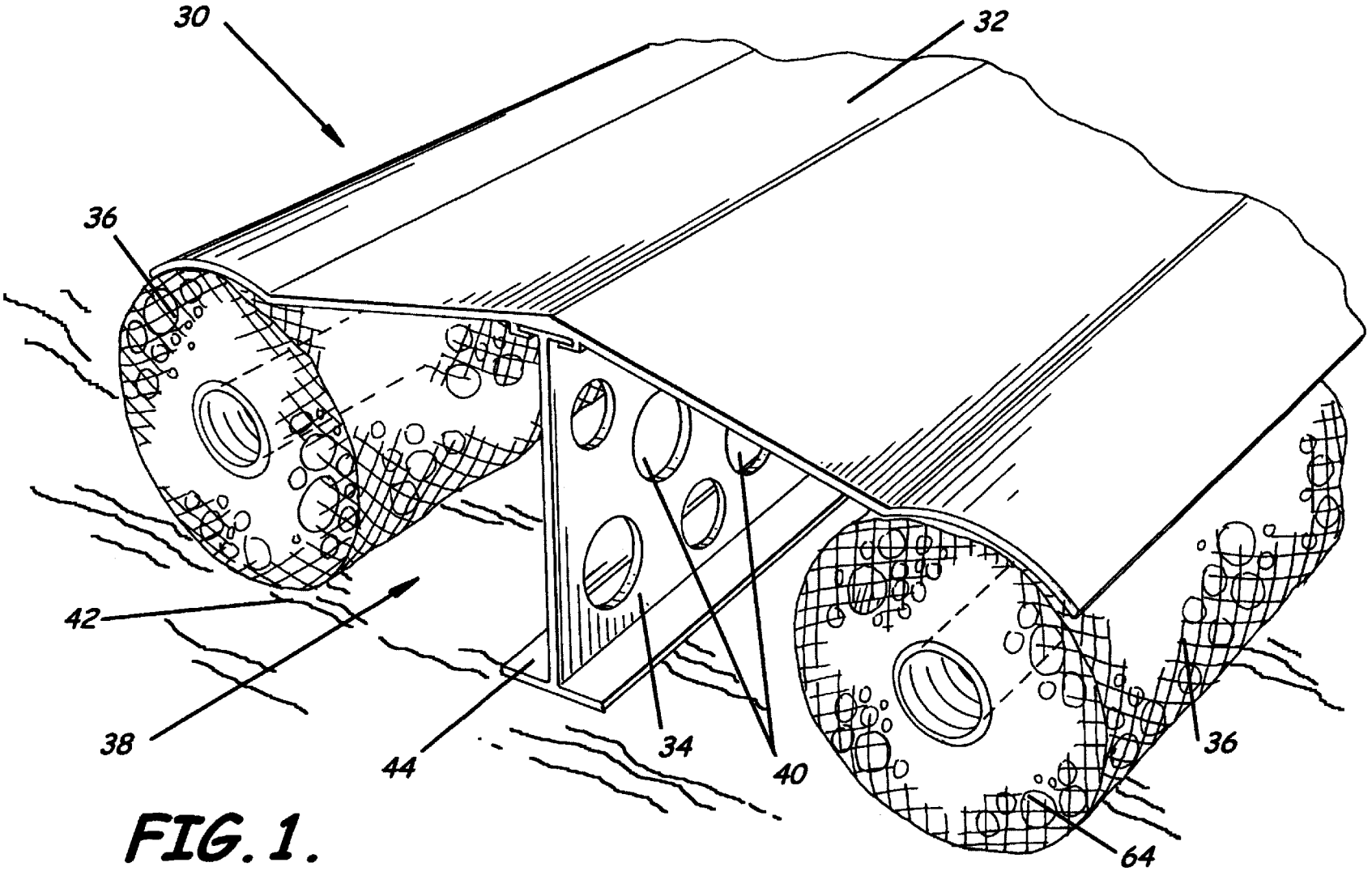

FIG. 1 shows a front perspective view of a chamber aggregate unit 30. The unit includes a cap 32, at least one support member 34, and a plurality of aggregate drainage lines 36. Preferred aggregate drainage lines are those described in U.S. Pat. Nos. 5,015,123 and 5,378,357 which are hereby incorporated by reference in their entirety. The aggregate drainage lines used in the present invention could be, for example, single lines or an arrangement of a plurality of lines as shown in FIGS. 4B and 4C in U.S. Pat. No. 5,015,123.

Figure 3:
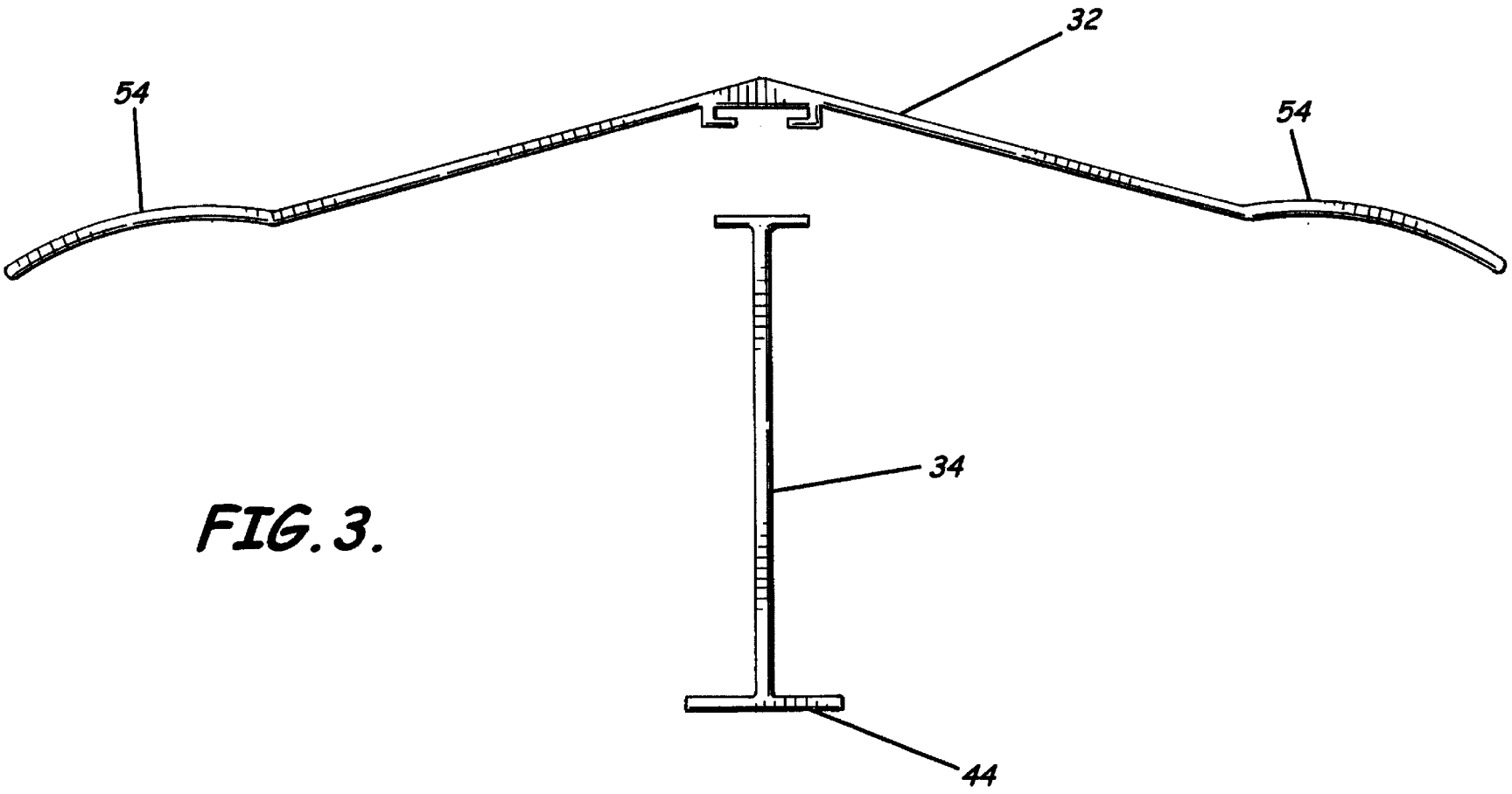
FIG. 3 is a front elevation view of an aggregate chamber structural members.

As seen in FIG. 1, void spaces created under the cap 32 and on either side of the support member 34 comprise the chamber portion 38 of the system. Chambers 38 allow the temporary storage of excess volumes of effluent, so that the drain field does not backup by suddenly filling with wastewater when demand on the system is greatest. Thus, chambers 38 provide a buffer of excess capacity in the system. The support member 34 preferably includes openings 40 allowing fluid communication between the chambers 38. These openings 40 may be round holes, as shown in FIG.1, but may also be shaped in any other desired geometry. The side walls of the chamber aggregate unit are formed by drainage lines 36 which may be conventional corrugated PVC perforated pipe as known to those skilled in the art, or may preferably be the preassembled aggregate drainage line units described in the patents referenced above. The bottom 42 of these chambers 38 is generally the soil at the bottom of the drainage trench itself. In operation of the invention, a source of effluent may be connected with drainage lines 36 comprising a perforated conduit surrounded with aggregate, as described in the previously referenced patents. An additional connection for handling heavy flows of effluent may be made directly to the chamber 38. Alternatively, the source of effluent may be connected to the chamber 38 only, and the side walls may be formed by conduitless aggregate units, as also described in the referenced patents. A detail view of the cap 32, support member 34 and foot plate 44 structural members of the aggregate chamber unit are shown in FIG. 3. As shown, the cap 32 may rest on drainage lines 36, or may be connected thereto as described below. Support member 34 may be connected to cap 32 by fitting into a slot positioned on an underside of the cap, or by other means known to the skilled.

Figure 1A:
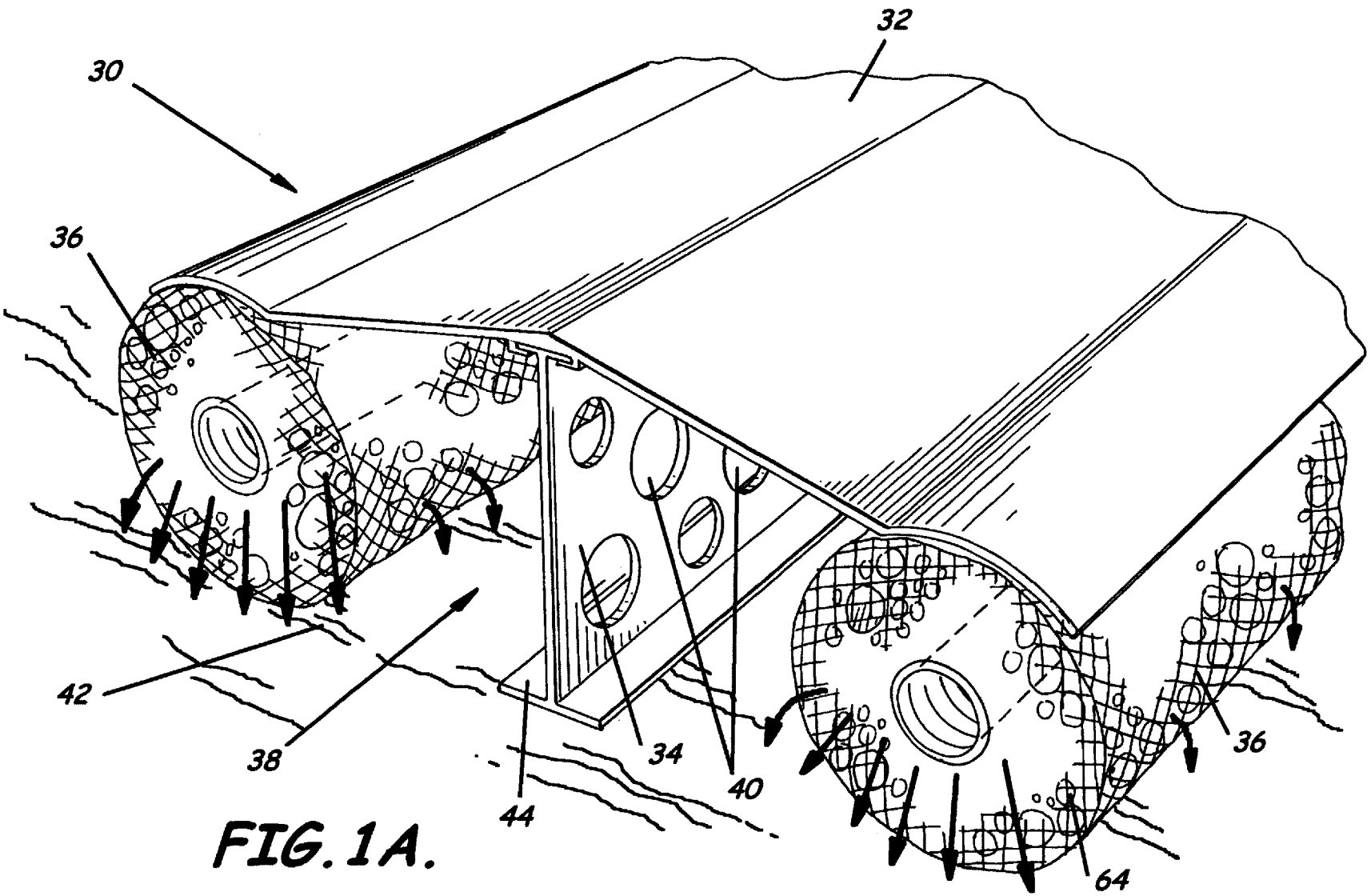
FIG. 1*a* shows effluent flow under normal flow conditions.
Figure 1B:
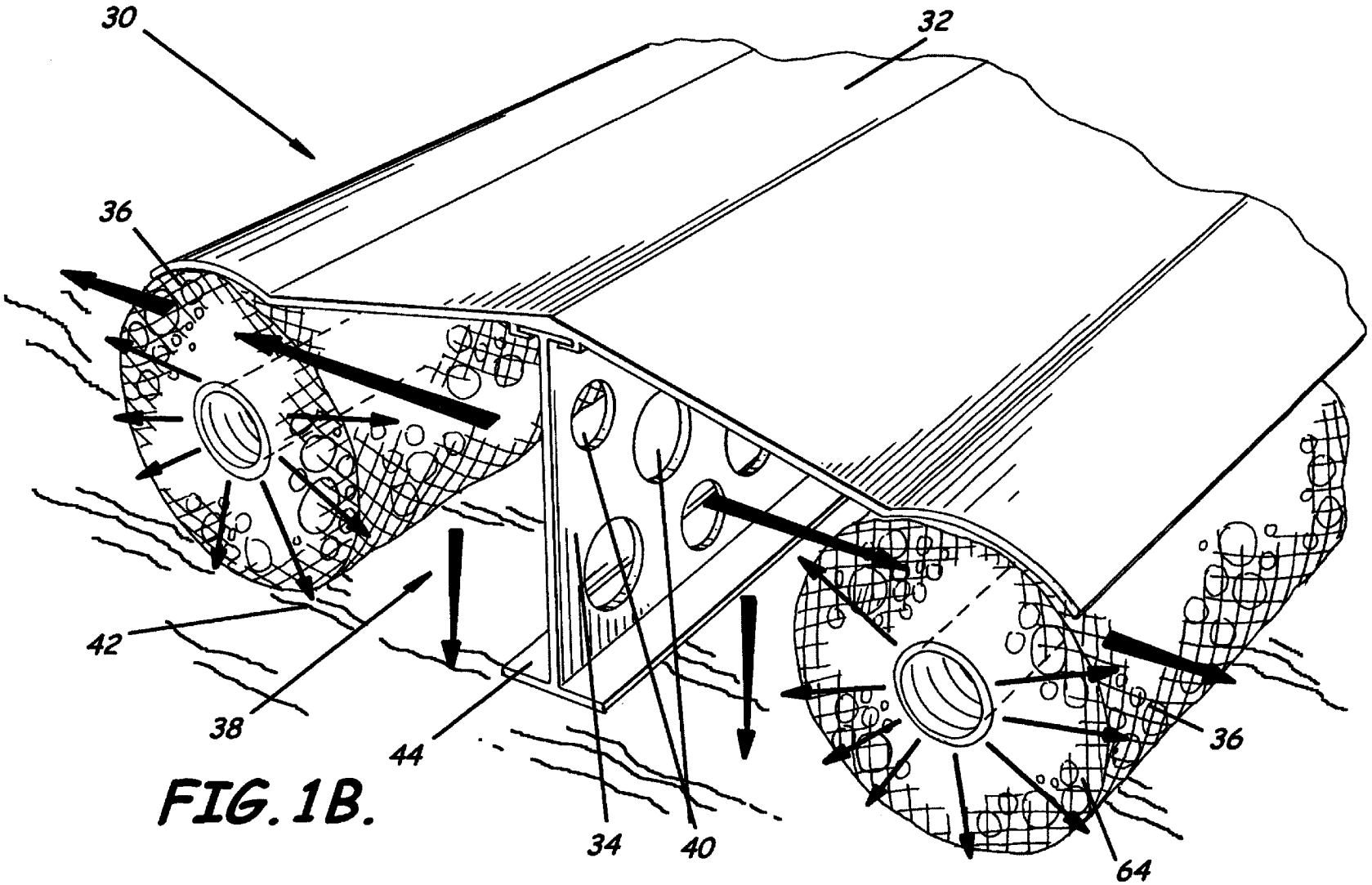
FIG. 1*b* shows effluent flow under high flow conditions.

As illustrated in FIGS. 1*a* and 1*b*, the invention also provides novel flow characteristics wherein the flow of effluent changes depending on volume for disposal. For example, under normal conditions effluent will generally flow into the soil of the trench through the lower periphery of the chamber cavity, as shown in FIG. 1*a*. Under excess flow conditions, as illustrated in FIG. 1*b*, or where the soil underlying the chamber cavity is unable to absorb the volume, effluent will accumulate in the chamber 38 and will flow from the chamber not only downwardly into the soil, but also laterally through side peripheries of the chamber cavity as indicated by the heavier arrows, thereby being filtered through the aggregate.

Figure 2:
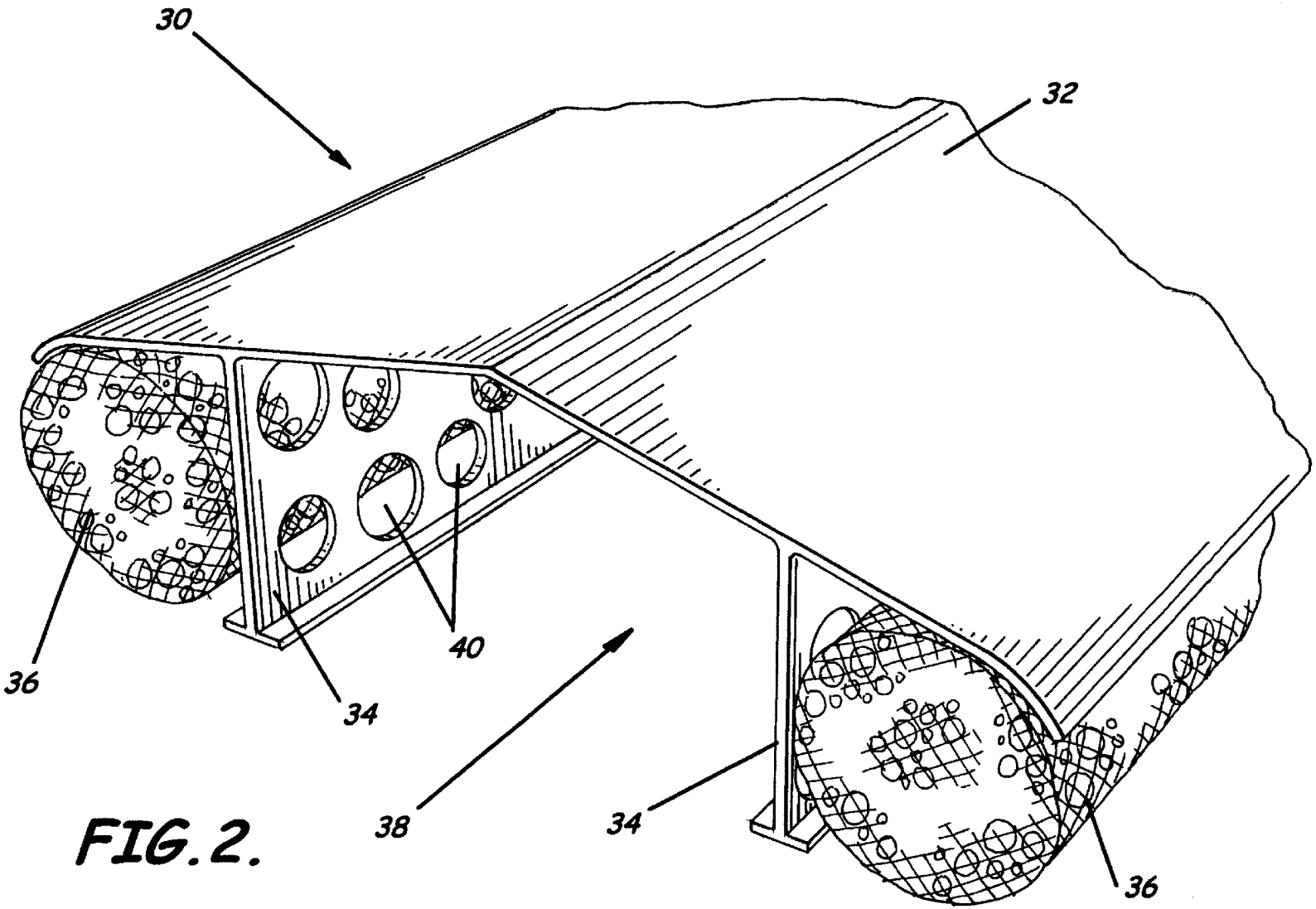
FIG. 2 is front perspective view of an alternate embodiment of a chamber aggregate drain line system.

FIG. 2 shows a front perspective view of an alternate embodiment of a chamber aggregate drain line unit 30A with two support members 34A each positioned adjacent a corresponding one of the lines 36A, with the unit 30A forming a single central chamber 38A.

Figure 4:
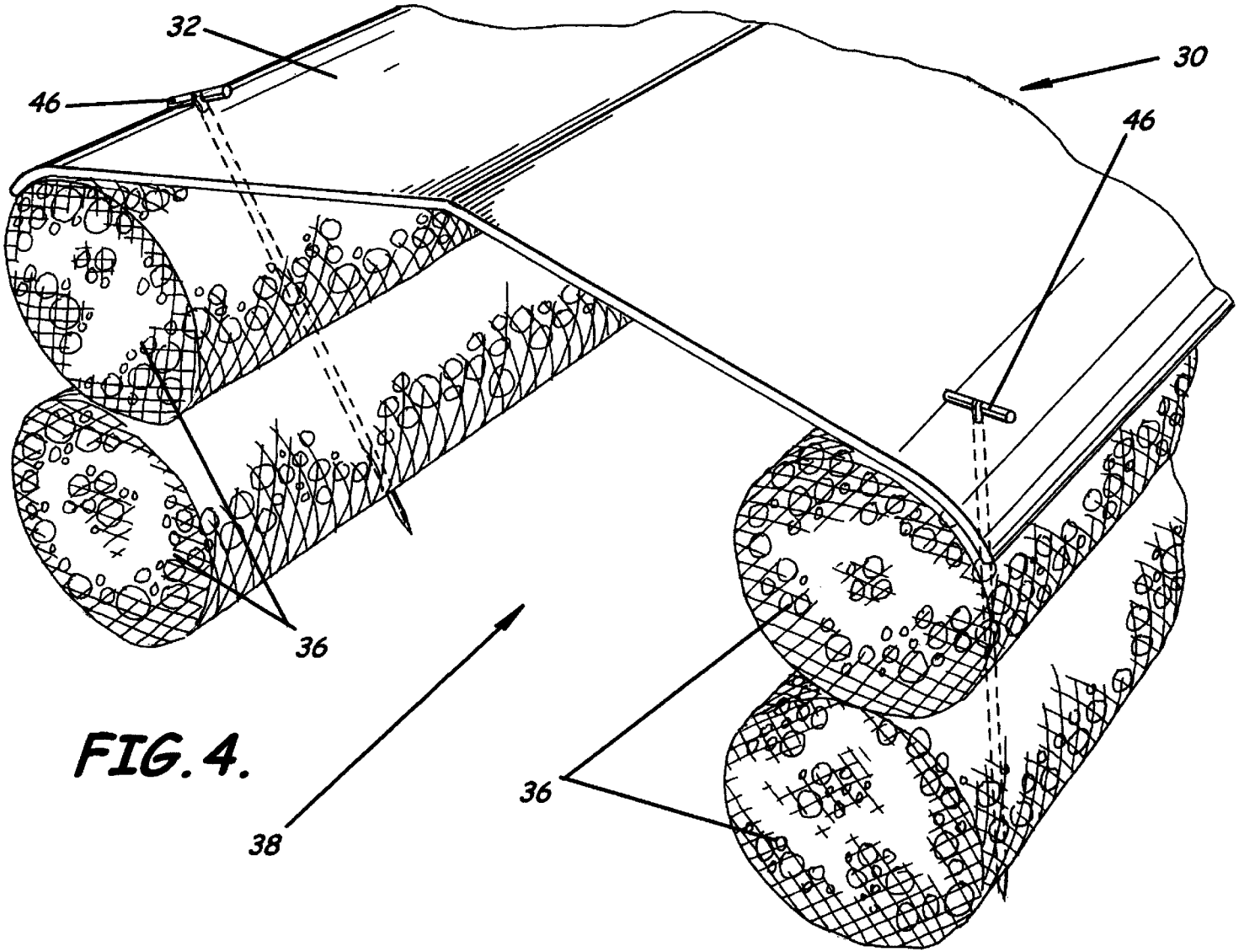
FIG. 4 shows a front perspective view of another embodiment of a chamber aggregate drain line system.
Figures 6, 6A, 6B, 6C:
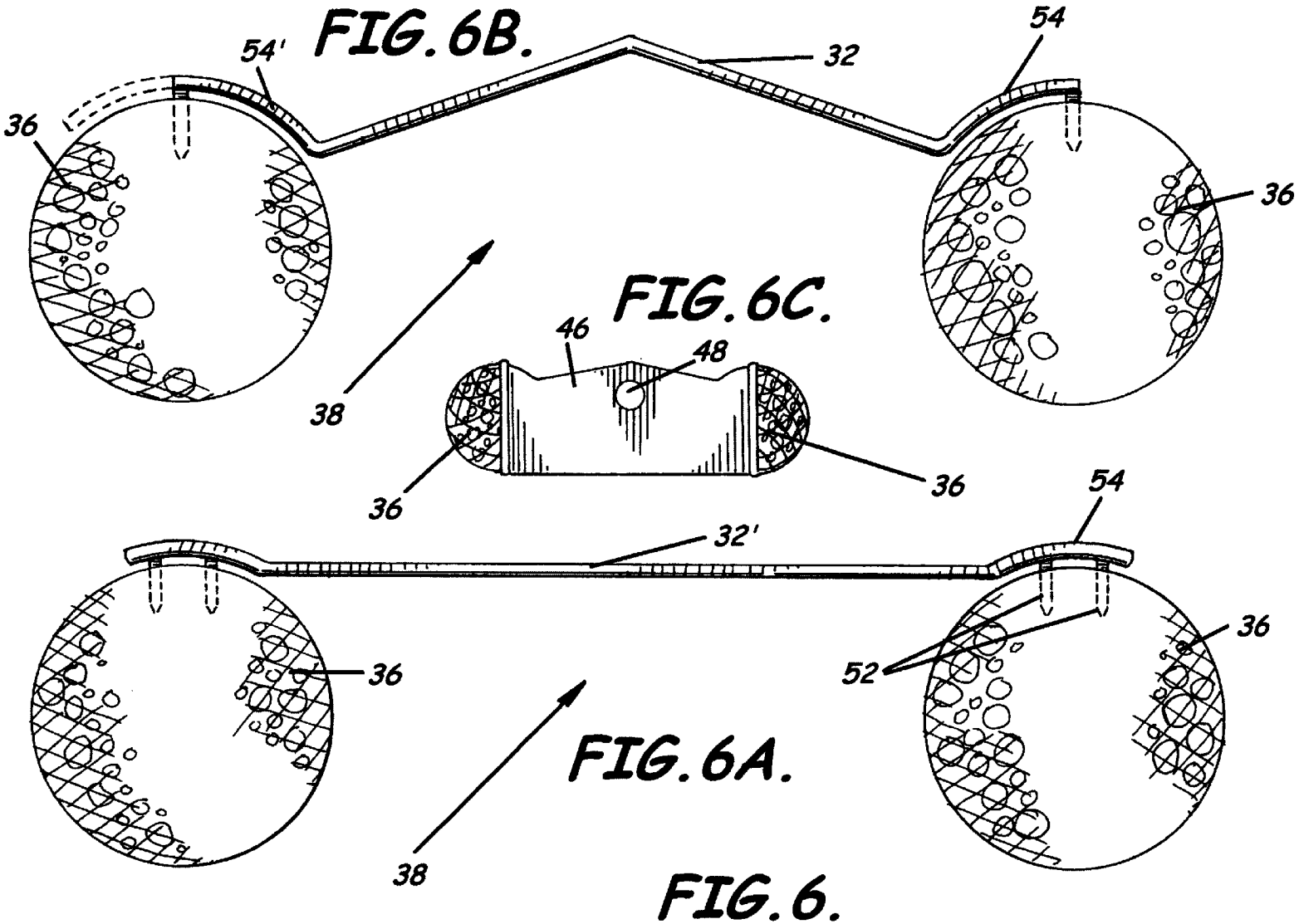
FIG. 6*a* and FIG. 6*b* are front elevation views of two variations of an embodiment of a chamber aggregate drain line system, shown in FIG. 6*c* having an end plate closing off the chamber.

Another embodiment of the aggregate chamber unit 30 is shown in FIG. 4, illustrating a front perspective view of the unit. As shown, this unit is disposed with at least two drainage lines 36 forming each side wall of the aggregate chamber 30. This unit is also shown with the cap 32 fully supported by the side walls, without the need for a support member. An aggregate chamber unit 30 without a support member, as shown in FIG. 4, results in a simplified installation, fewer component parts, and reduced costs. Those skilled in the art will appreciate that this and other embodiments of the invention may be constructed with a variable number of drainage lines 36 forming the side walls, depending on the design characteristics of the given drainage project. Also shown in FIG. 4 are pins 46 extending through the cap 32 and through the drainage lines 36 forming the side walls of the unit 30 for laterally stabilizing the cap 32 with the lines 36, and for also stabilizing the unit within a drainage trench. Pins 46 or other devices known in the art may also be positioned on the chamber side of the side walls 36, so that the side walls are stabilized in place between the pins and the trench wall. Various additional structural elements of the aggregate chamber embodiment are illustrated in FIG. 5. The open ends of the aggregate chamber unit 30 may be closed with a face plate 46 across the opening, as shown in FIG. 5*a*. The face plate 46 may be connected to the unit 30 by means known to those skilled in the art, for example by the use of fasteners, by interlocking tabs molded into the opposing pieces, and the like. Face plate 46 preferably includes a pipe opening 48 for connecting with a pipe, the face plate preferably being disposed with a splash guard member 50, as shown in FIGS. 5*c*, 5*d* and 5*e*. The splash guard 50 aids in preventing erosion of the soil at the bottom of the trench by water streaming from the discharge pipe. In an alternate embodiment, the splash guard could be a member 50P inwardly into the chamber from a lower side of the face plate, the flat panel splash guard resting on the bottom of the trench for receiving the stream of water as shown in FIG. 23. FIG. 6 includes front elevation views of two variations of this embodiment of the chamber aggregate drain line unit 30. The cap member 32 may be flat, as shown in FIG. 6*a*, or may have a peak or ridge, as shown in FIG. 6*b*, providing the cap with a slope and added structural strength. In addition, there may be spikes 52 extending from semicircular fins 54 positioned laterally on the cap. These fins 54 are intended for positioning onto the drainage lines 36 forming the side walls. The spikes 52 shown in this embodiment provide a way of holding the drainage lines 36 in place. One or more spikes 52 may be used, and their length may be varied, for example, to hold two or more drainage lines 36 in place.

Figures 7, 7A:
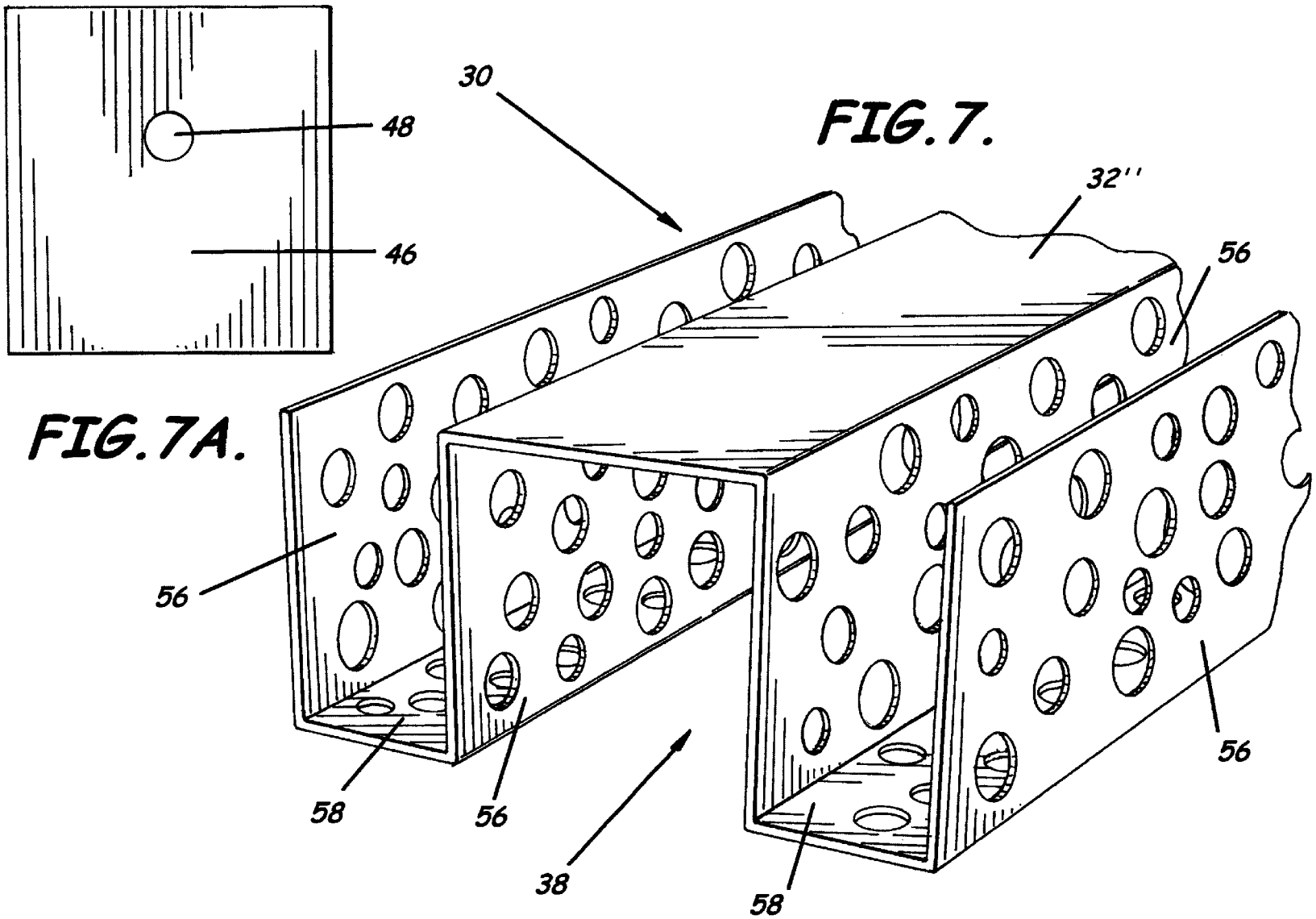

In another preferred embodiment, the aggregate chamber unit 30 may be formed by a plurality of flat panels, as shown in FIG. 7 in a front perspective view. In this embodiment, side wall panels 56, a foot plate panel 58, and a cap panel 32" may all be formed as separate pieces which are connected together to form the aggregate chamber, as shown. Alternatively, this configuration may be manufactured as a single piece having creases forming flexible connections among the multiple panels, the creases serving as folds along which the entire assembly may be folded into the form of an aggregate chamber 30, as seen in FIG. 7. For example, the aggregate chamber of FIG. 11 may be set up from such a folding panel 62, as shown in FIG. 12. As illustrated in FIG. 7*b*, aggregate 64 is placed in the space formed between the side walls 56, so that the aggregate space is located between the chamber cavity 38 and the walls of the trench. Those skilled in the art will appreciate that the aggregate for use in this and other embodiments of the invention may be any conventional aggregate material such as stone gravel, but is preferably a lightweight material such as suitably sized pieces of various plastics. In particular, expanded polystyrene has been found to be well suited as an aggregate in these applications. Additionally, recycled materials such as plastics including polyethylene, polyurethane, and polypropylene, as well as rubber chips from ground up vehicle tires may be used. The aggregate 64 may be in loose form, as shown in FIG. 7*b*, or may be advantageously contained within a prefabricated, water permeable package or sleeve 36, such as a mesh bag, as shown in FIGS. 1, 2, 4, 5, 6, 9 and 18, or as in prefabricated drainage line units as described in U.S. Pat. No. 5,015,123.

FIGS. 8 through 11 illustrate several embodiments of the aggregate chamber of FIG. 7. FIG. 8 shows an aggregate chamber 30 system having a rounded or arched cap 32", and wherein aggregate chambers may have side walls 56 positioned at an angle relative to the side walls of the trench, as seen in FIG. 8*b*. The arched cap 32" provides a degree of increased strength against collapse from the weight of the overlying soil cover. Additionally, the roundedness of the cap 32" tends to guide any water filtering through the soil above the system, such as rainwater drainage, into the aggregate 64, rather than directly into the chamber portion 38. The rounded top 32" may alternatively include openings to allow water to flow through the cap into the chamber 38. The round top 32" may be constructed as a rigid, preformed arched top, or may be a flexible panel which is contoured at the job site by bending into place within the drainage trench. Bending a flexible top panel 32" into the rounded or arched shape preferably provides stress tending to push the side aggregate channels into the side walls of the drainage trench, thereby creating a stronger drainage system.

Figures 9, 9A, 9B:
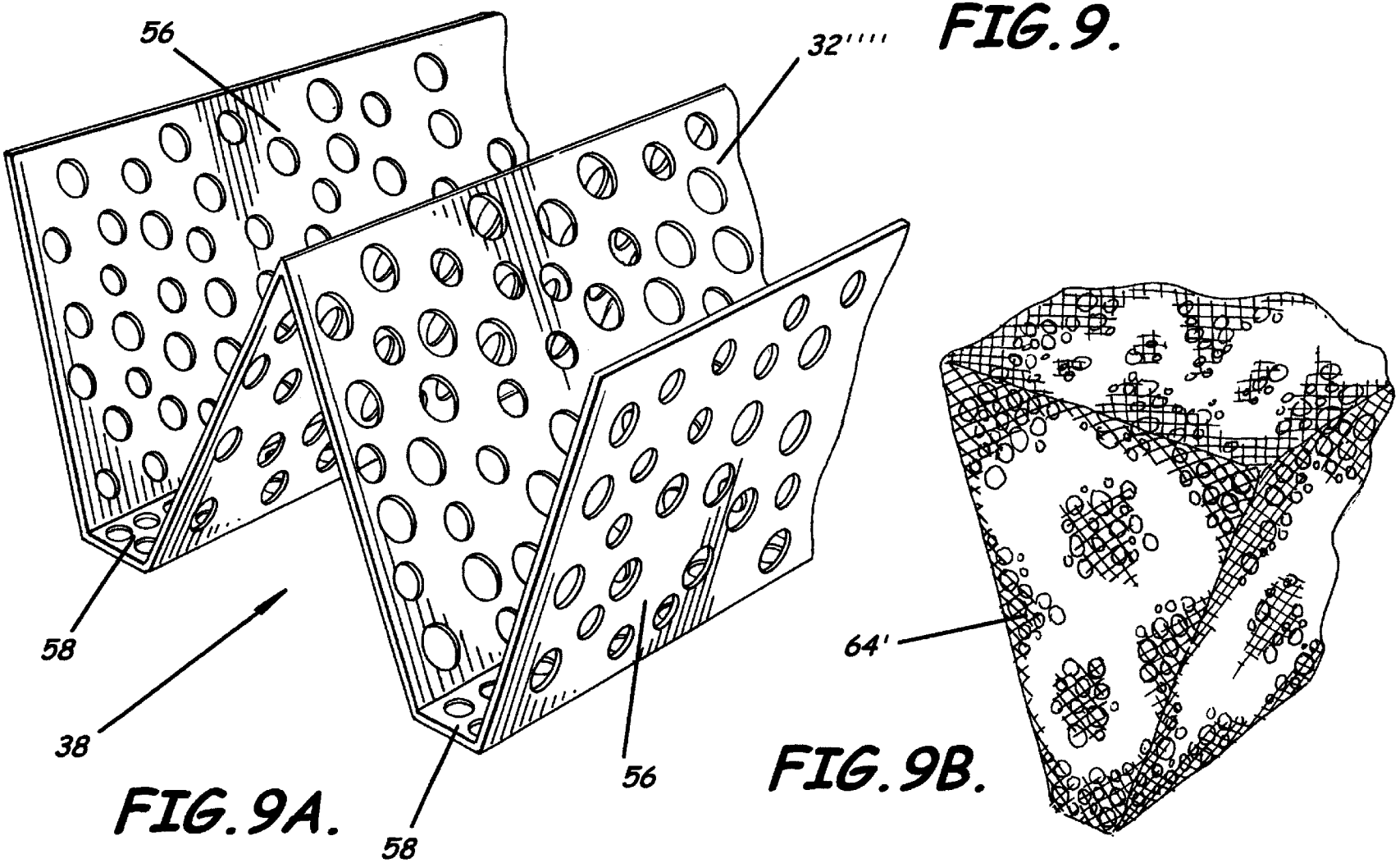
Figure 9C:
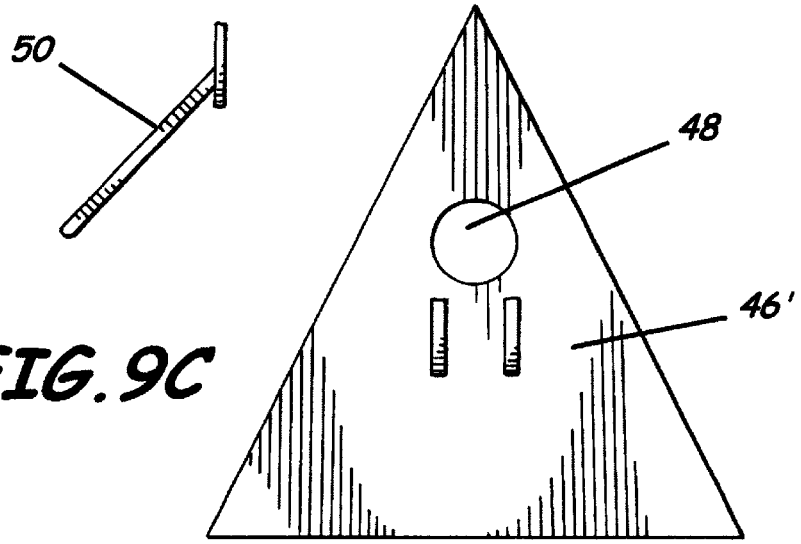
FIG. 9*c* shows an end plate and splash guard for same.
Figure 9D:
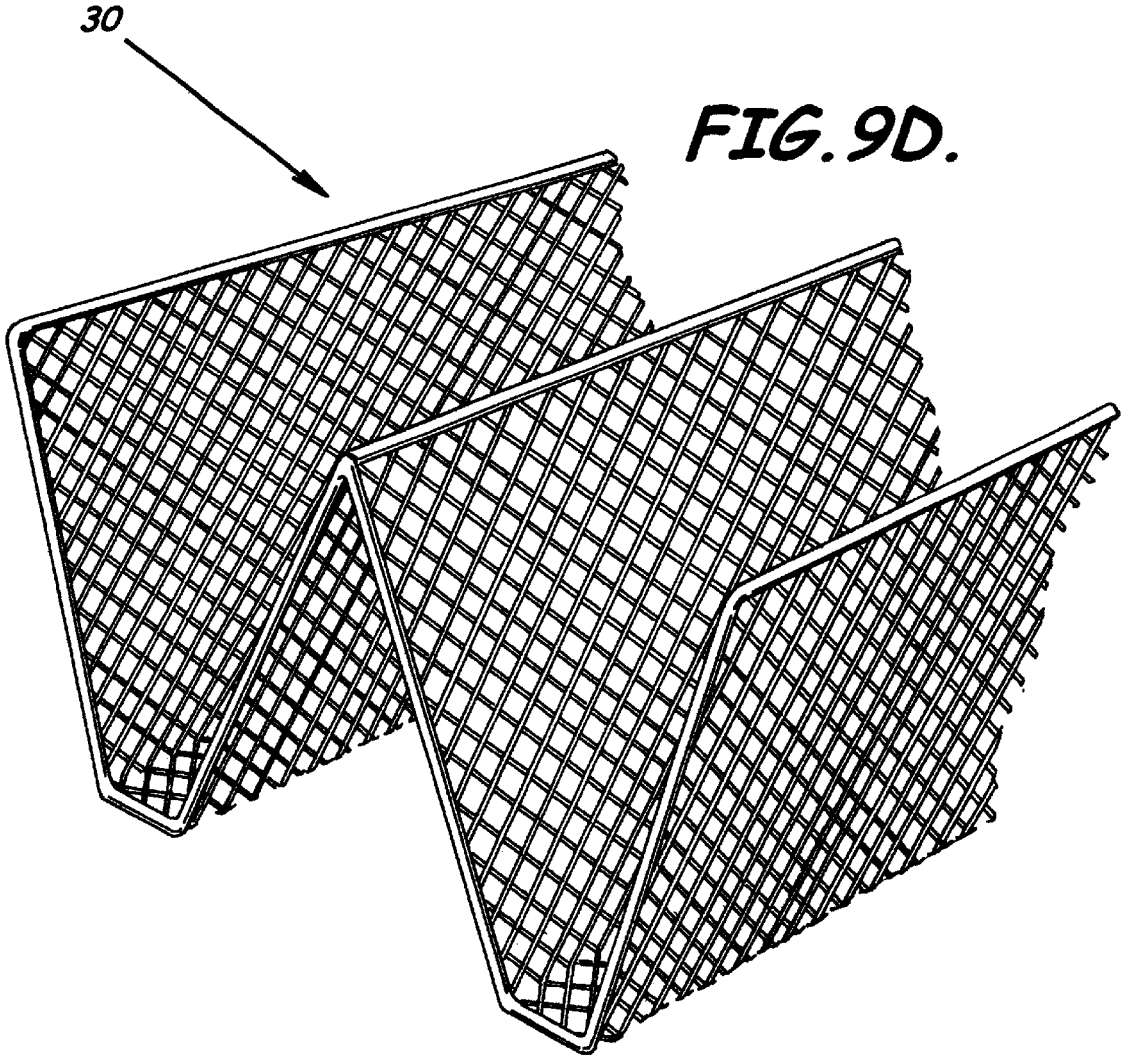
FIG. 9*d* shows a "W" shaped chamber formed from a mesh material.

FIG. 9 shows a front perspective view of a chamber unit 30 having a cross section substantially shaped as a "W" This alternate embodiment may also be constructed of folding panels, as described above. The folding panels allow for very easy placement of the system into a drainage trench. Those skilled in the art will appreciate that such a "W" configuration, as shown in FIG. 9*a*, allows for easily varying the width and depth of the trench in which the system is installed, as the "W" may be narrowed or widened to meet the demands of the installation site. A preformed bag of aggregate 64, as seen in FIG. 9*b*, may be installed in this configuration of aggregate chamber. Alternatively, loose aggregate may be used to fill the aggregate channels. As discussed for other chamber configurations, the "W" design allows for construction either with separate panels which are joined together on site, or by use of a one-piece folding panel. Either approach provides the advantages of flat pieces which greatly facilitate storage and transportation of the system to the job site. An end plate 46' and splash guard 50 for use with the "W" configuration of the aggregate chamber are shown in FIG. 9*c*. Yet another variation of this embodiment is shown in FIG. 9*d*, where the "W" configuration aggregate chamber 30 is constructed of a mesh material, preferably a plastic or corrosion resistant expanded metal mesh. FIG. 10 shows a front elevation of the "W" shaped chamber aggregate drain line system placed within a drainage trench. The positioning of the "W" aggregate chamber in trenches of various widths is illustrated in FIGS. 10*a* and 10*b*. A perforated cover may be placed over the aggregate chamber, as shown in FIG. 10*a*, having openings configured so as to substantially prevent soil penetration into the aggregate channels. The skilled will know, however, that the chamber 30 may also be operated without a cover.

Figures 11, 11A, 11B:
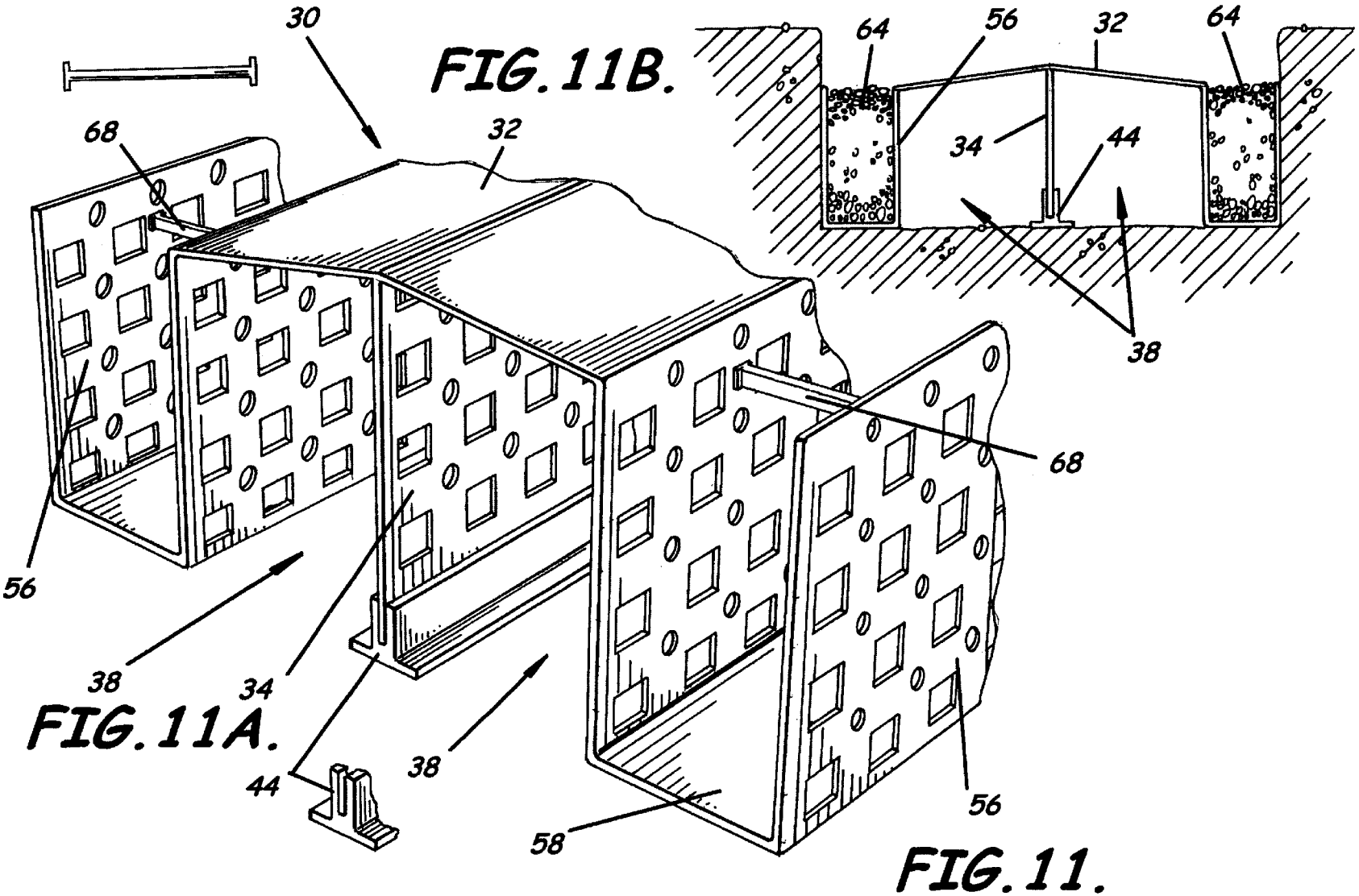
Figure 11C:
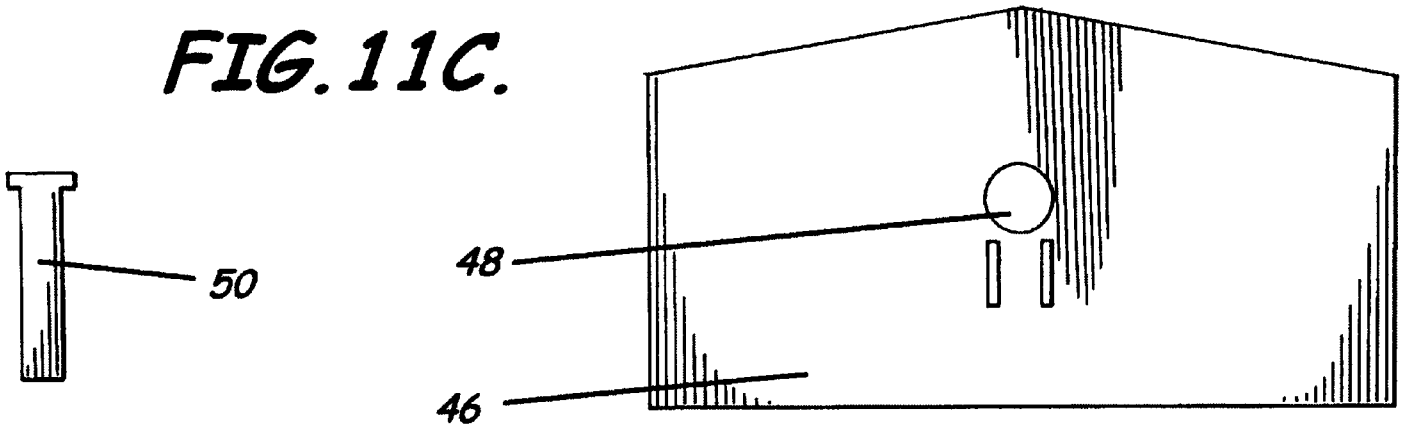
FIG. 11*c* shows and end plate and splash guard for same.
Figure 12:
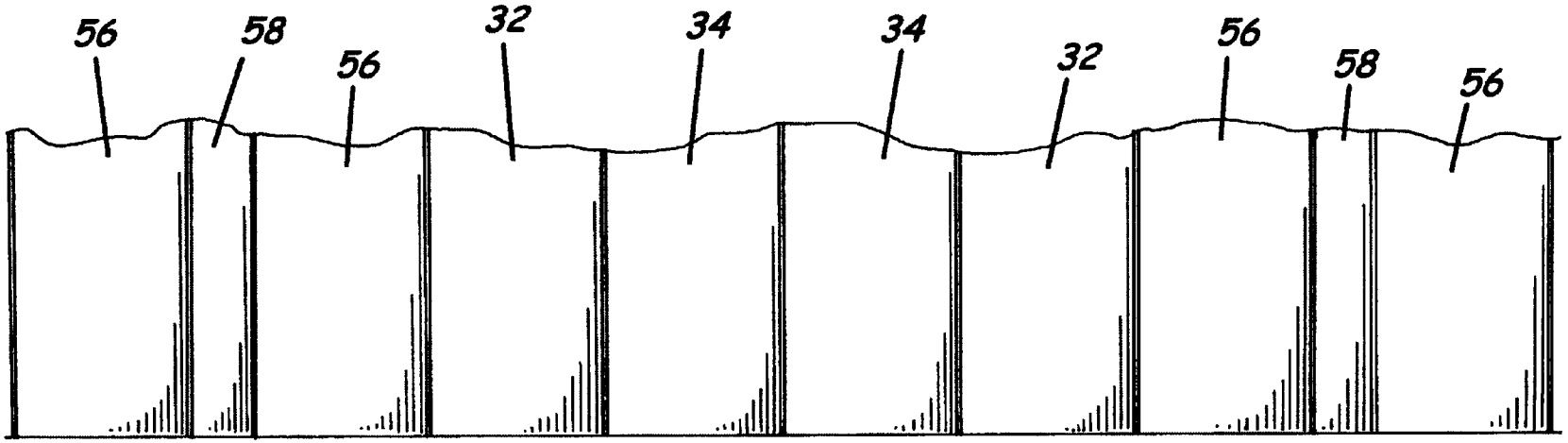
FIG. 12 is a top plan view of an array of flat folding panels for assembling into a chamber aggregate drain line system such as shown in FIG. 11*a;*

Yet another preferred embodiment of the system is shown in FIG. 11, a front perspective view of a chamber drain line 30 formed by substantially flat panels, and including a double chamber 38 in the central portion of the drainage line assembly. Those skilled in the art will appreciate that such a double chamber will accommodate a larger peak volume of drainage water. Conversely, the double chamber line will also require a wider drainage trench for placement, and may further require a vertical support member 34 positioned between the chambers 38, as also shown in FIG. 11. Such a dual chamber system may be well suited for sites where large peak flows must be periodically handled, such as in stormwater drainage applications. A face plate 46 and splash guard 50 for the dual chamber system are shown in FIG. 11*c*. Support brackets 68 are shown in FIG. 11 in position for supporting the side walls 56 of the aggregate space. The skilled will know that such support brackets may be used, as desired, with any of the embodiments of the invention.

Figure 13:
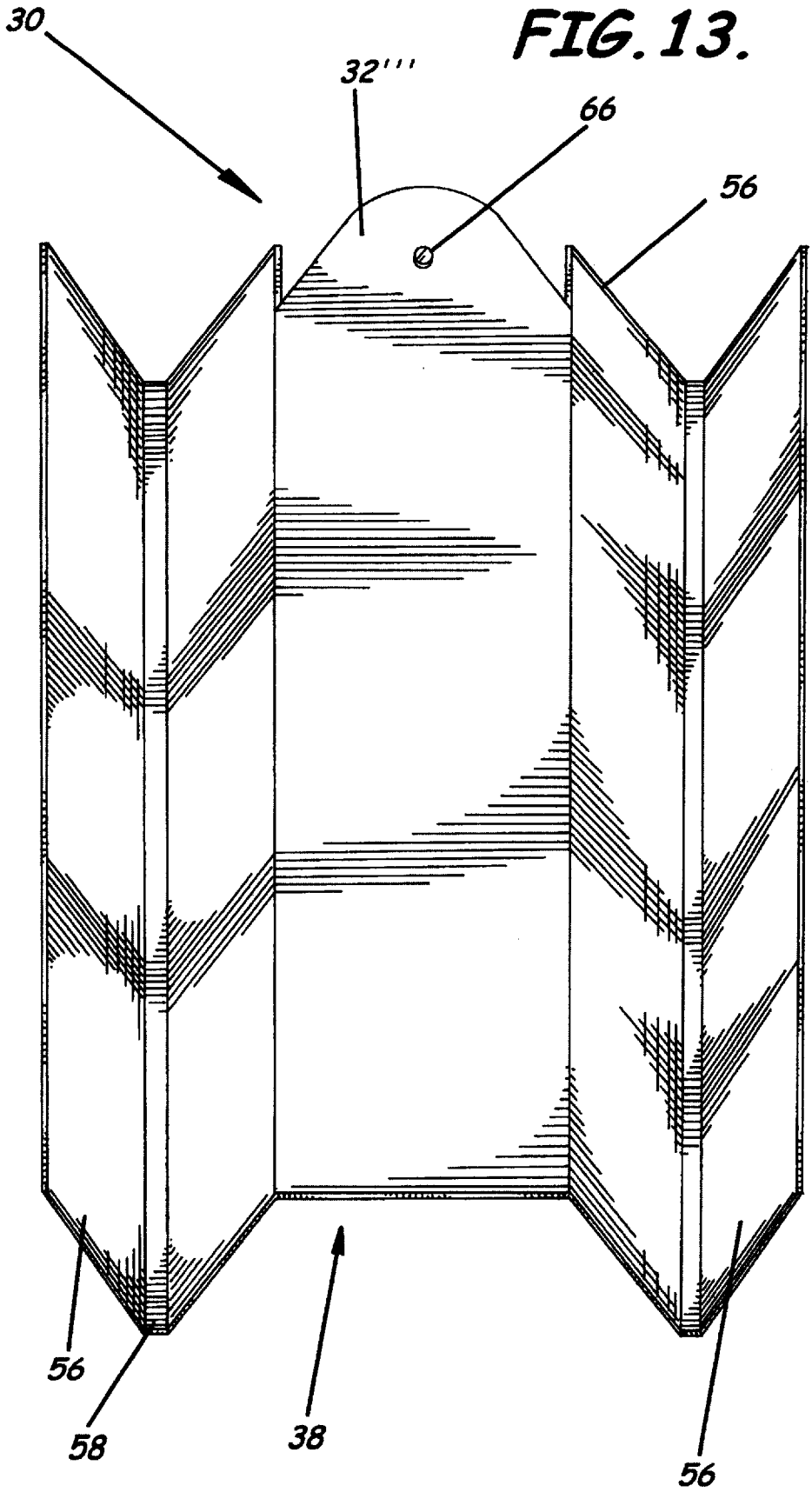
FIG. 13 is a top perspective view showing a chamber aggregate drain line unit suitable for constructing a turn in a drain line.
Figure 14:
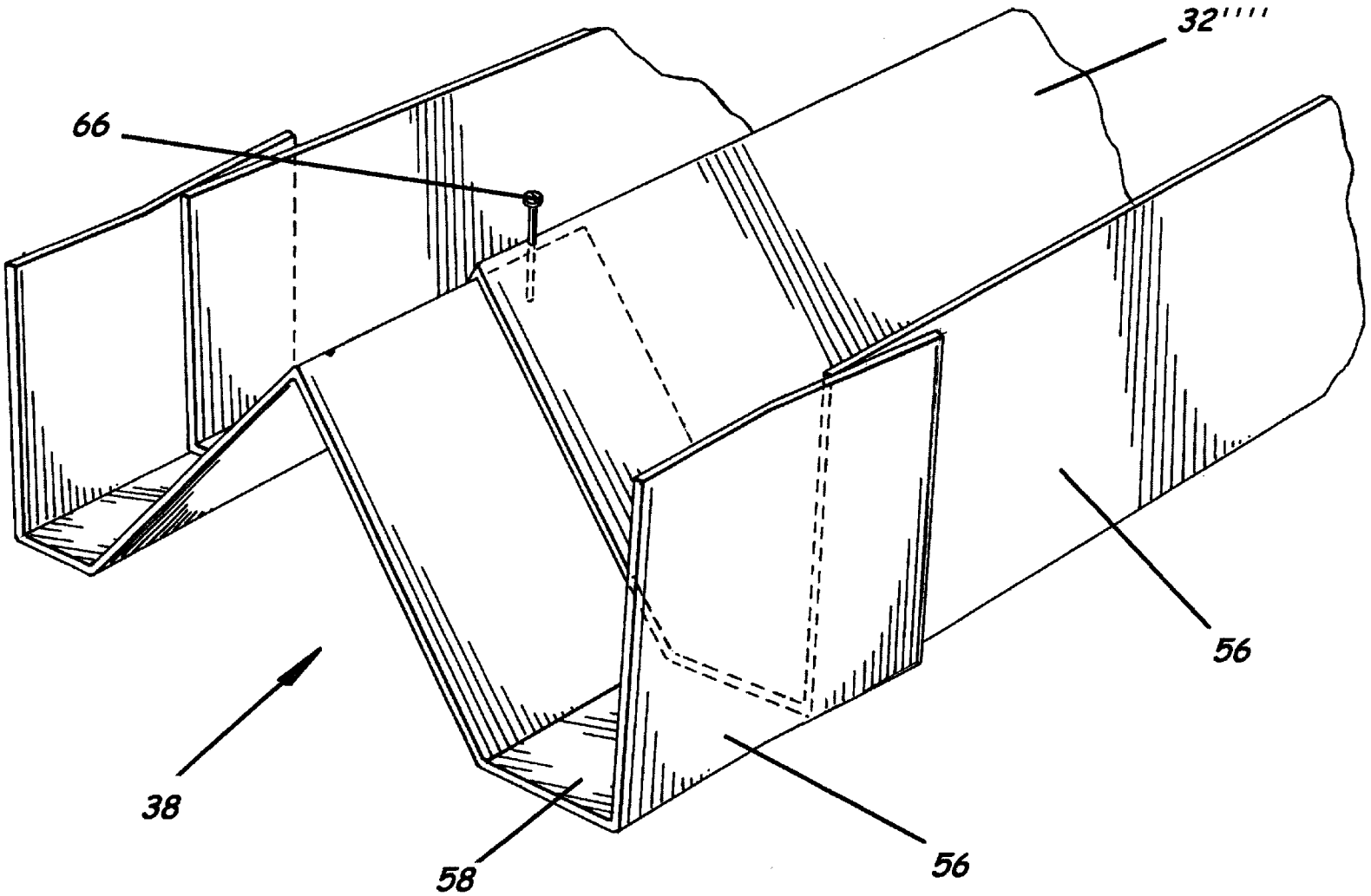
FIG. 14 shows a front perspective view of two drain line units connected together for making a turn in a drain line.
Figure 15:
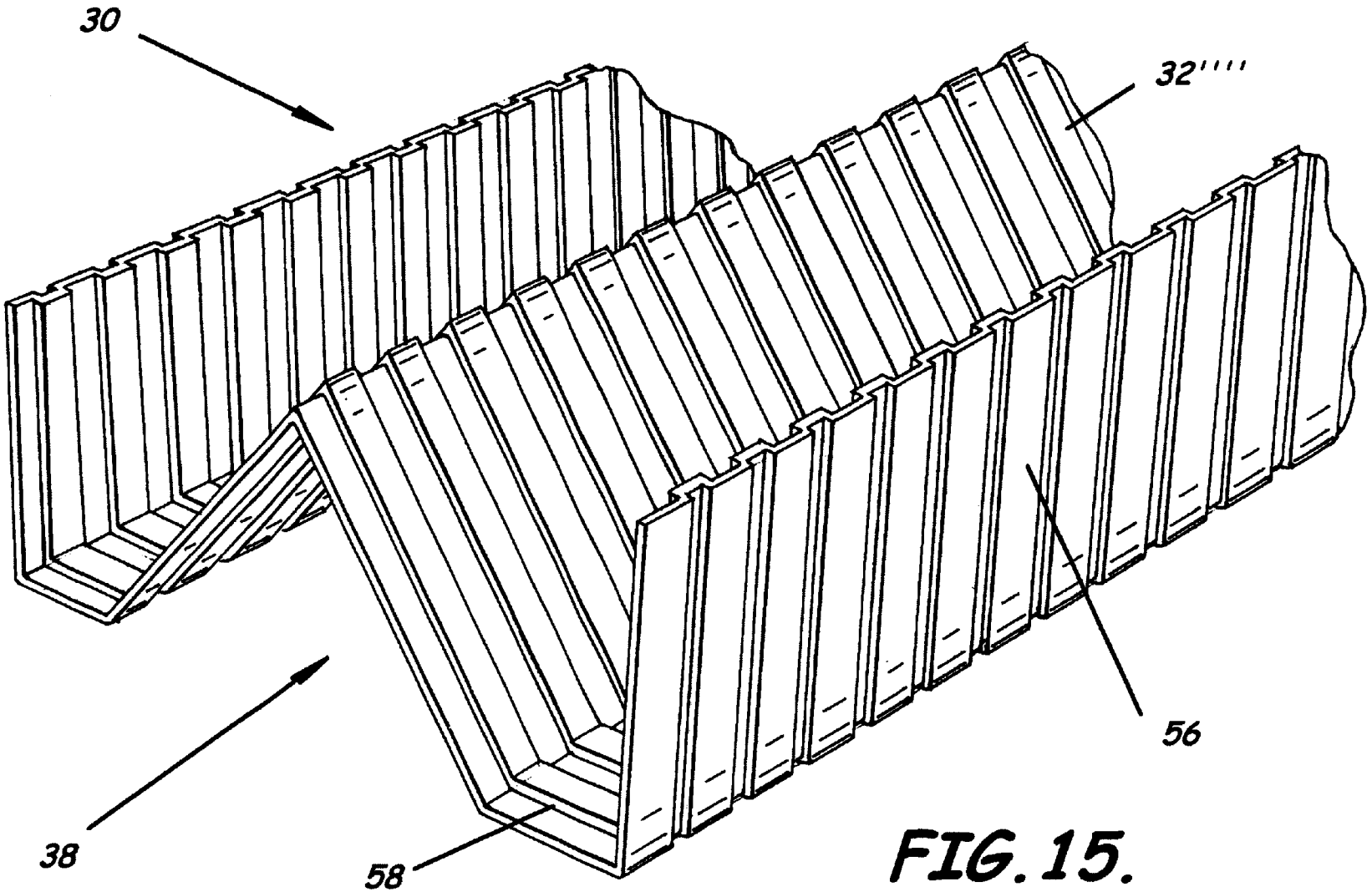
FIG. 15 shows a chamber aggregate drain line unit built of corrugated walls to permit bending.

FIGS. 13 through 17 generally illustrate various embodiments of the present invention wherein drainage line units are particularly configured for forming turns in the drainage lines. FIG. 13 is a top perspective view showing a chamber drain line unit 30 suitable for constructing a turn in a drain line. In this embodiment, one end of the unit 30 has been shaped to provide cut-out areas which will engage with another unit in such a way as to permit a gradual turning of an assembled drainage line, as shown in FIG. 14. The coupled units may preferably be secured to one another through the use of a pivot pin 66, as shown in FIG. 14 with another embodiment of the invention. Yet another approach for creating turns in an assembled drainage line is shown in FIG. 15. In this embodiment, units 30 are constructed having corrugations which create flexibility in the unit. Each unit may be flexed to a degree, much as standard corrugated drain pipe, to create various turns in the assembled drain line.

Figure 16:
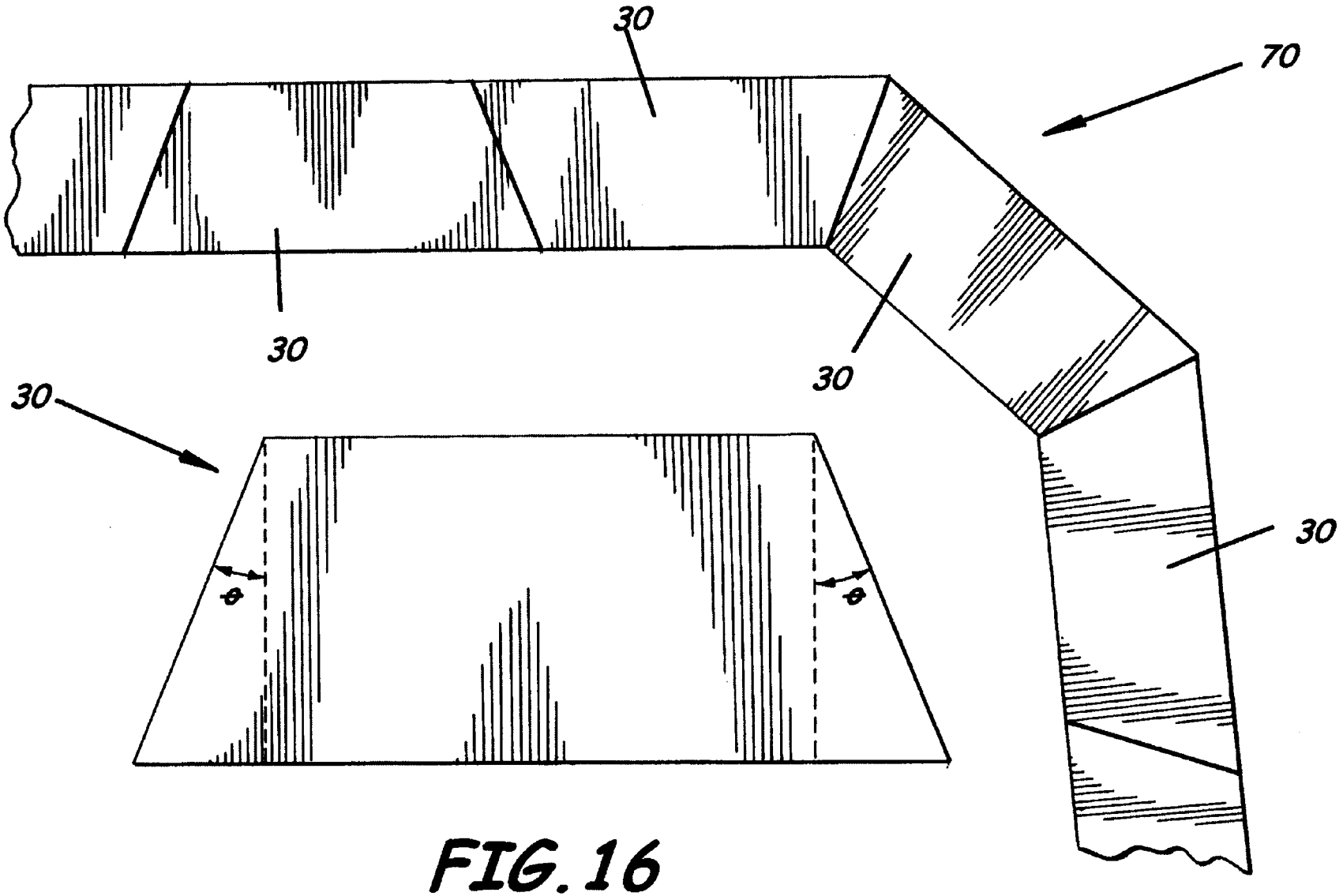
FIG. 16*a* shows a top plan view of a chamber aggregate drain line unit having its ends shaped for allowing construction of curved drain line systems such as shown in top view in FIG. 16*b;*
Figure 17:
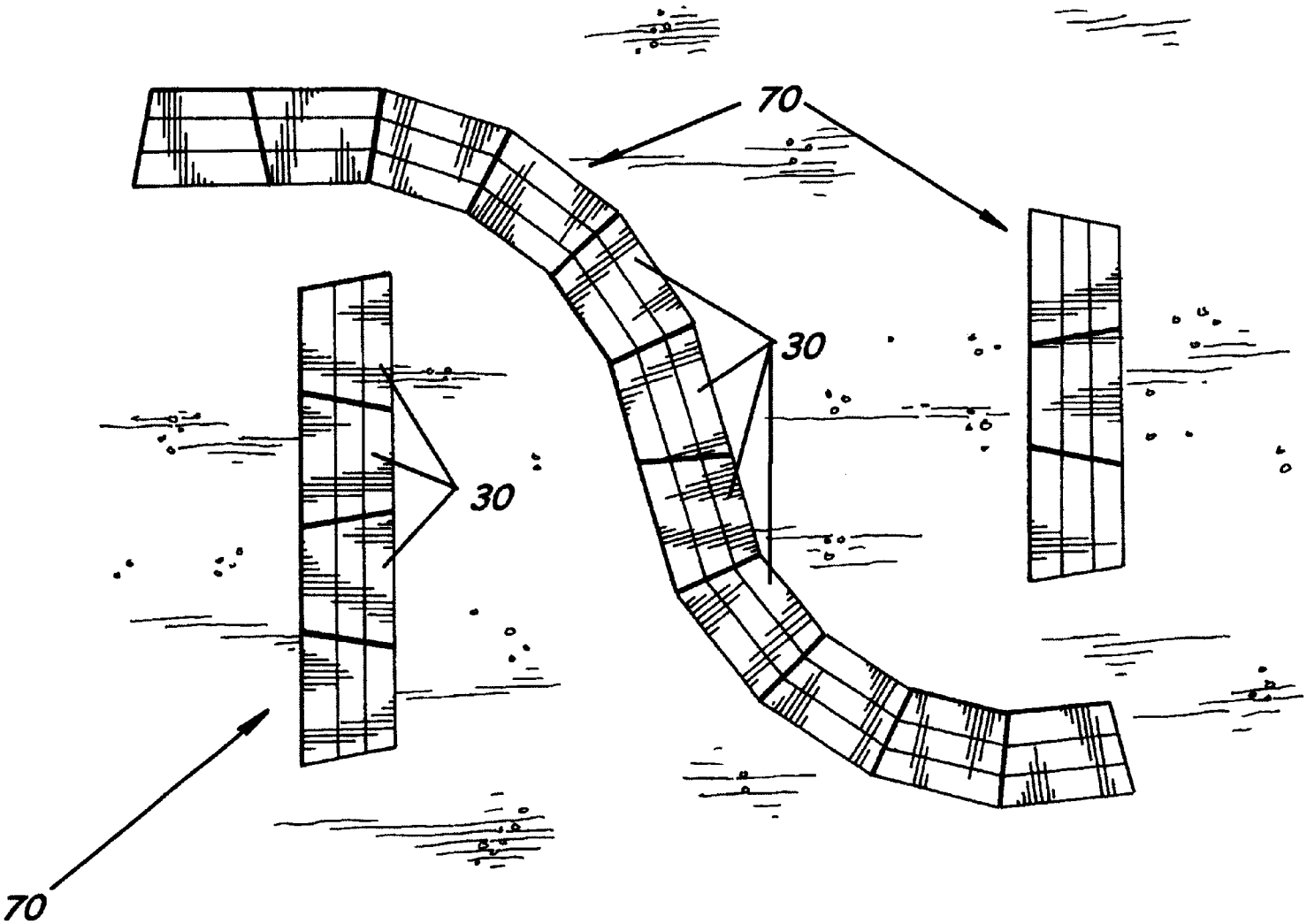
FIGS. 17*a*, 17*b* and 17*c* are top plan views of chamber aggregate drain line units in another alternate embodiment suitable for constructing a drain lines in either straight or turning configurations, as shown.

Another embodiment of a drain line unit for constructing a leach field having turns in the drainage line is shown in top plan view in FIG. 16. In this embodiment, the units 30 are constructed having a generally trapezoidal, so that the unit comprises an end set at a predetermined angle ($\theta$) relative to a longitudinal dimension of the unit, as illustrated. By appropriately combining these units end to end, a drainage line 70 may be constructed either in straight line or to create turns, as shown in FIG. 16. The trapezoidal angles may be varied to construct curved drainage lines which fit the requirements of a job site, such as shown in top plan view in FIG. 17. In addition, either one or both ends of a unit 30 may be set at an angle for constructing curved drainage lines.

Figure 18:
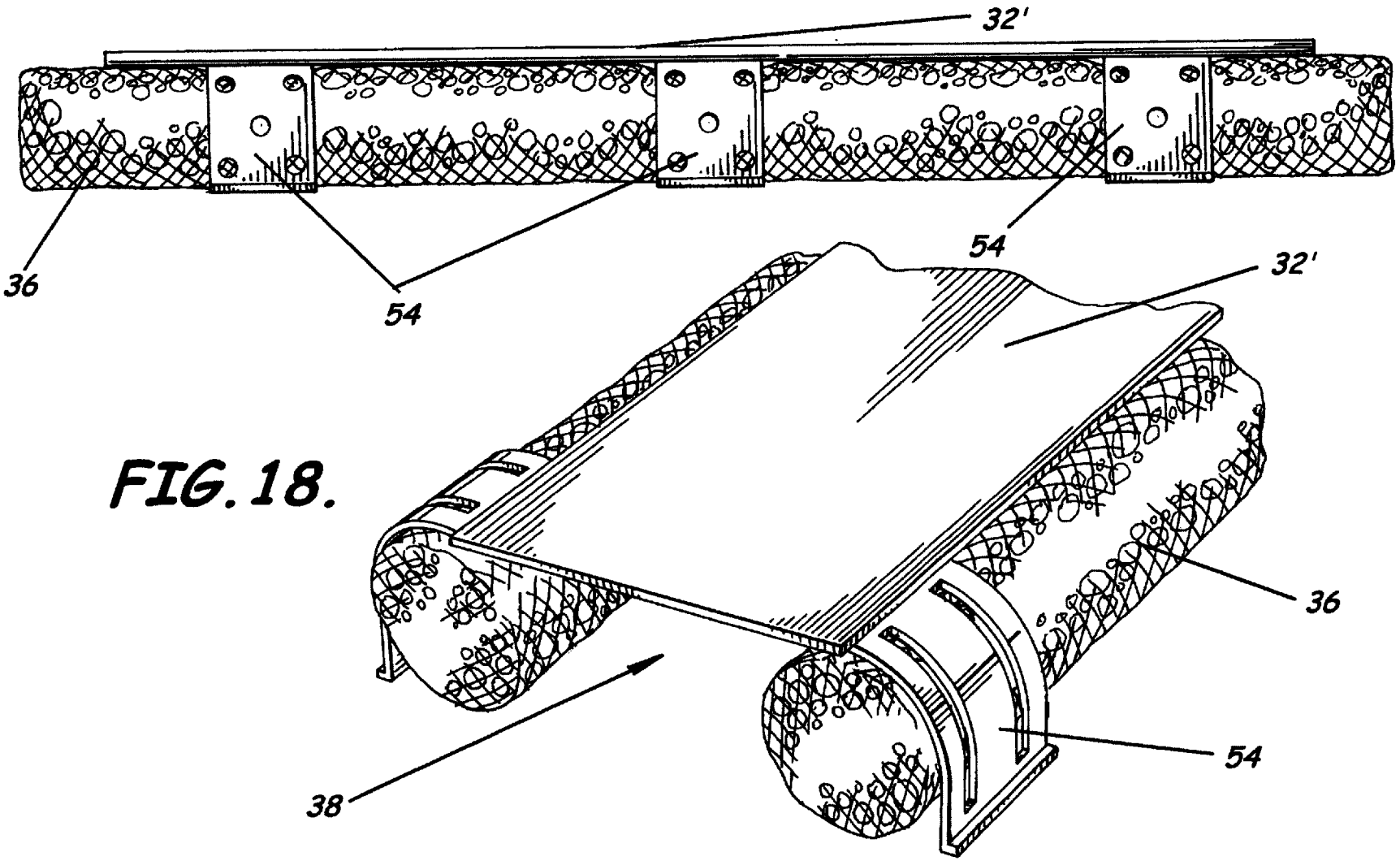
FIG. 18*a* shows a front perspective view of an embodiment of a chamber aggregate drain line system.
FIG. 18*b* shows a side elevation view of same.
Figure 19:
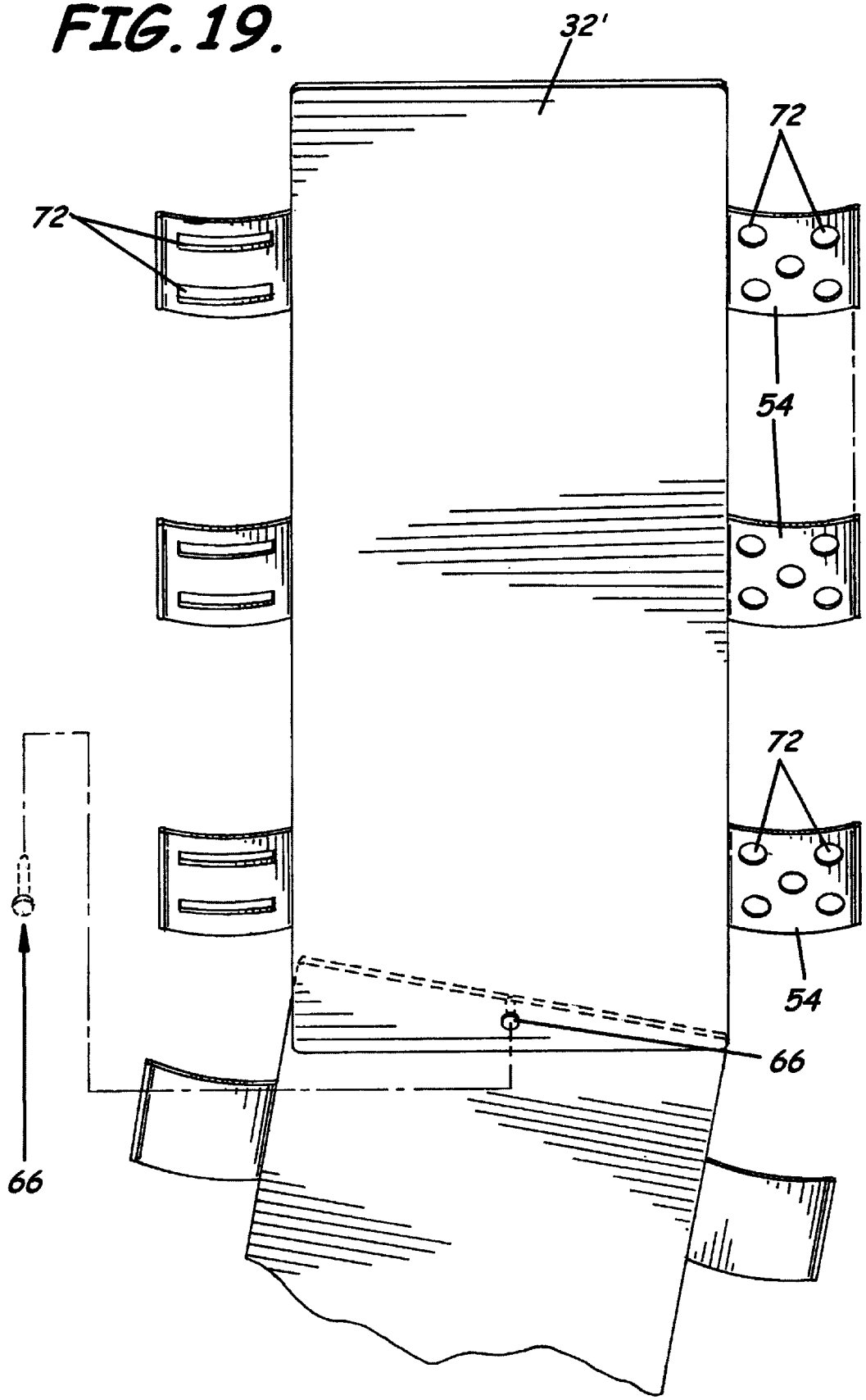
FIG. 19 is a top plan view of a chamber aggregate drain line unit shown in FIG. 18, illustrating how a turn would be made in a drain line.
Figure 20:
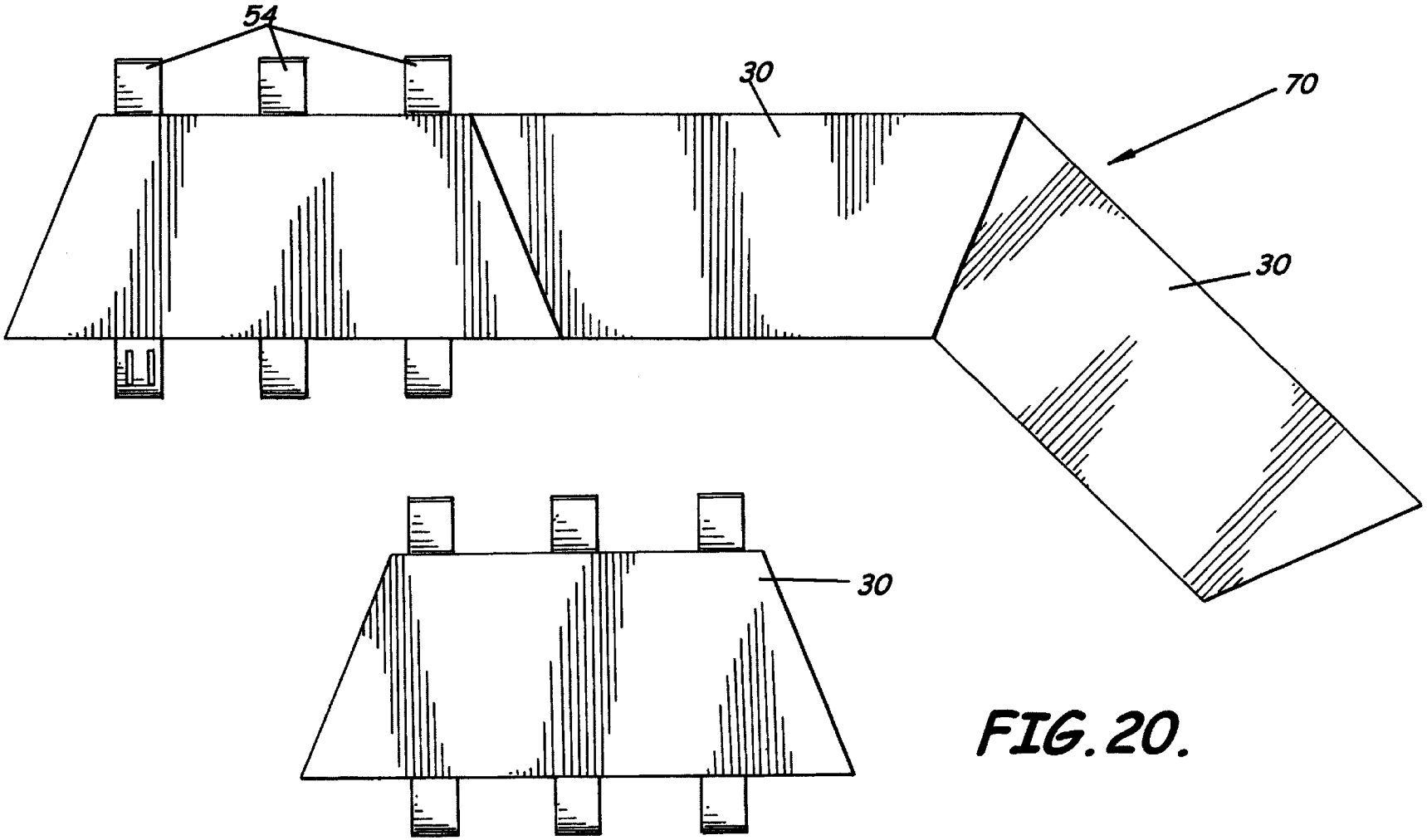
FIG. 20*a* is a top plan view of a variation of the chamber units of FIG. 18 showing yet another method of creating a turn in a drain line, as shown in FIG. 20*b;*

A further embodiment of the chamber system of the invention is shown in FIGS. 18 through 20. This embodiment is a variation of the units described above for FIGS. 1–6. FIG. 18 shows side and front perspective views of a chamber drain line, wherein the top panel of the unit 30 includes a plurality of lateral fins 54. This embodiment of the chamber system also includes aggregate material enclosed within a mesh tube 36, perforated drainage pipe, or preferably the preassembled drainage line units described in U.S. Pat. Nos. 5,015,123 and 5,378,357. As noted previously, these drainage line units may comprise a conduit, or may be conduitless as described in the referenced patents. The fins 54 may be attached to the cap 32' by any means known in the art, or they may be an integral part of the cap, such as by the combination being molded as one piece of a plastic material. The lateral fins 54 may be generally somewhat flexible so that they can be bent into place over the aggregate tubes, or they may be more rigid, with a preformed shape contoured for positioning over the aggregate tubes, as shown in FIG. 19 The lateral fins 54 may be connected to the aggregate tubes and to the ground by any means known to those skilled in the art. Also shown in FIG. 19, the fins may additionally be perforated to allow for passage of water, the openings 72 having any desired shape. These units may be connected with a slight overlap, as shown in FIG. 19, to form turns in the drainage line. The connected units may be secured to each other by a pivot pin 66, screw, or other suitable means as known in the art. Additionally, these units may be configured having a trapezoidal top plan, that is, comprising at least one end set at predetermined angle relative to a longitudinal dimension of the unit, as shown in top plan view in FIG. 20, so that they can be connected end to end, forming turns in the drainage line.

Figure 21:
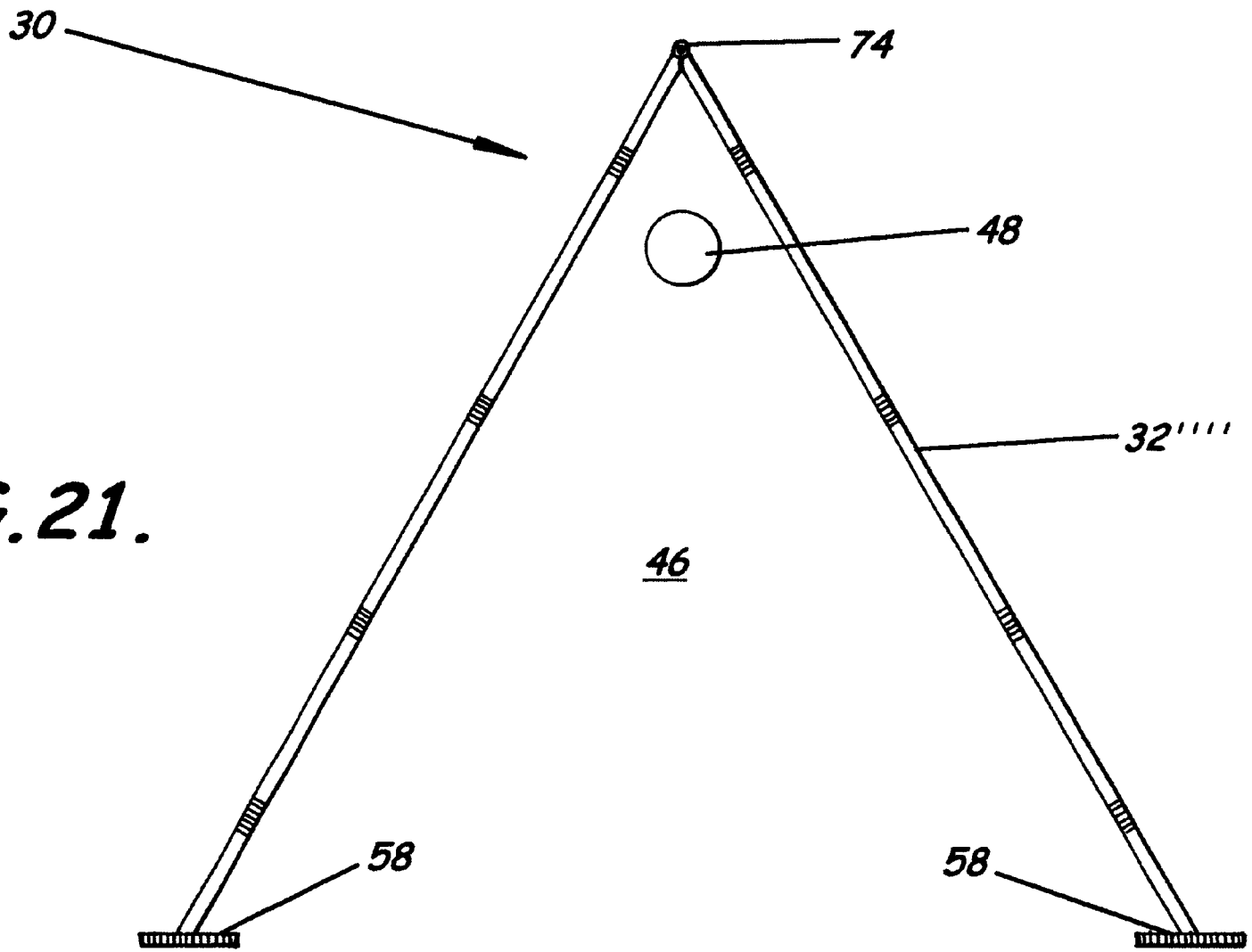
FIG. 21 is a front elevation view of a triangular chamber drain line unit.
Figure 22:
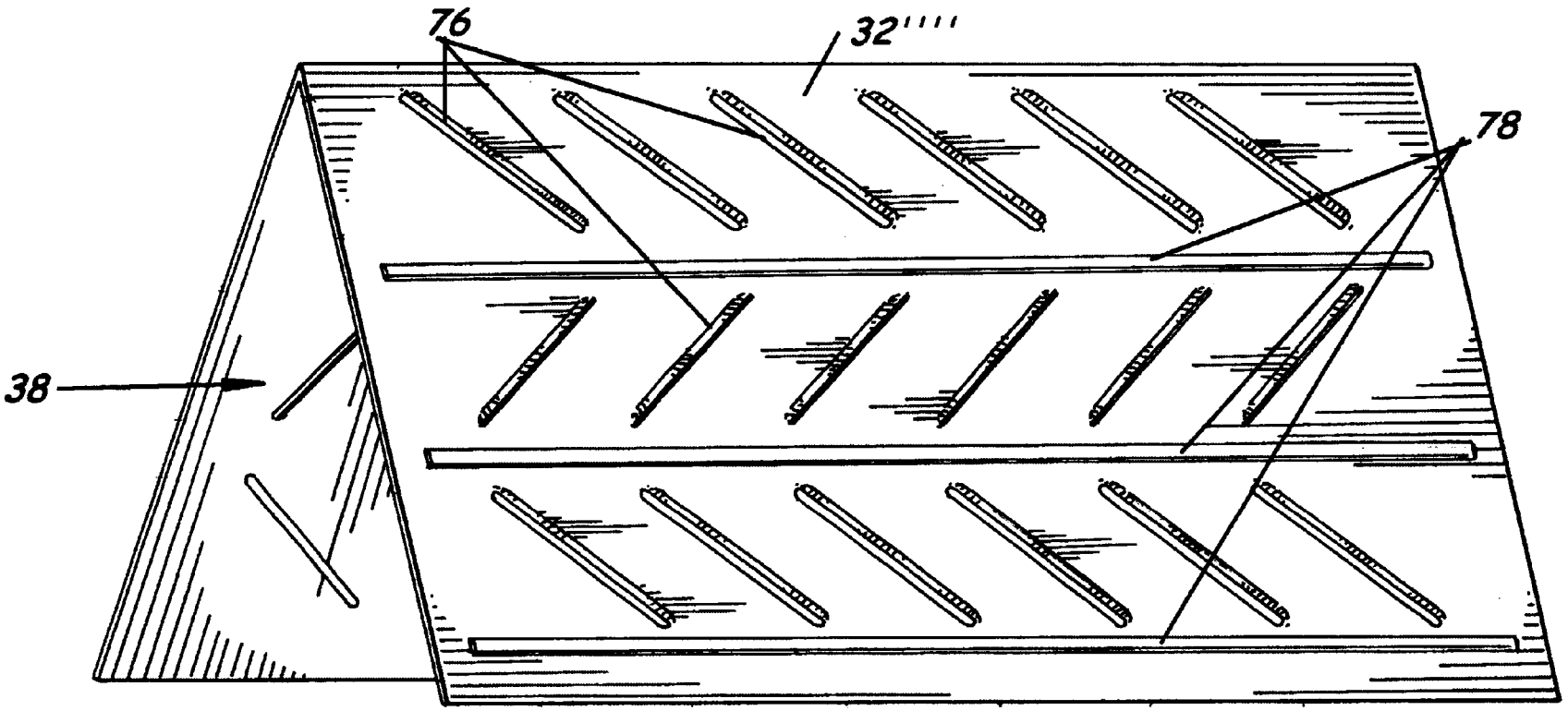
FIG. 22 shows a side elevation of a triangular chamber unit having openings in the side wall.

FIGS. 21 through 23 illustrate details of a chamber unit 30 having a cross section generally of an inverted "V". These units may be constructed of two individual substantially flat panels 32" which are joined by means of a hinge pin 74, or may be one single panel having a flexible joint allowing the panel to be folded into the inverted "V" configuration shown. In addition, two other panels may be added to the inverted "V" to form a "W" configuration, where the two outer channels may be filled with aggregate, similar to those units shown in FIGS. 9 and 10. The inverted "V" chamber, however, may be used alone as shown in FIGS. 21–23, without aggregate. Preferably, the panels are perforated to allow flow of water out into the soil. As shown in FIG. 22, the openings 76 may be louvers or slots, or may preferably be configured similar to the openings on a common food grater, wherein a slot has overlapping lips to help prevent soil penetration into the chamber. The panels preferably also include ribs 78, as shown in FIG. 22, positioned to add structural strength to the panels, thereby to help prevent collapse of the drainage line under the weight of the covering soil. A front elevation view of a face plate panel 46 for the drainage unit of this embodiment is shown in FIG. 23. As with other face plates described herein, the face plate panel 46 may be connected to the drainage line unit by any means known to those skilled in the art. Preferably, the face plate 46 and side panels include connecting joints, so that the panels may be snapped together. An example of such connecting joint would be a dovetail including mortise and tenon portions, as known in the art. As the other face plates described herein, FIG. 23*a* shows a pipe inlet opening 48 in the panel. Two configurations for splash guards 50 50' are also shown in FIG. 23*b*, to help prevent erosion of the soil from the bottom of the drainage trench. Additionally, foot plates 44 may be provided to aid in stabilizing the panels 32 forming the inverted "V" drainage unit, as shown in FIG. 21. Foot plates 44 will also help prevent the panels from sinking into the soil as the bottom of the trench becomes saturated with water.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An aggregate chamber for leaching effluent into a leach field, comprising:

a chamber cavity for therein receiving effluent for leaching;

at least one panel positioned to define a first periphery of said chamber cavity; and a plurality of aggregate drainage lines positioned adjacent said panel so as to define second and third peripheries of said chamber cavity, each drainage line of the plurality having a perforated conduit for connecting to a source of effluent and a lightweight particulate aggregate substantially contained within a water permeable material for filtering the effluent.

2. The aggregate chamber of claim 1, wherein said aggregate comprises a material selected from expanded polystyrene, polyethylene, polyurethane, polypropylene, and rubber chips.

3. The aggregate chamber of claim 1, wherein said panel further comprises a plurality of foldingly connected substantially flat panels.

4. The aggregate chamber of claim 1, further comprising an opening into said chamber cavity for therethrough making a fluid connection with a source of effluent.

5. The aggregate chamber of claim 1, further comprising a splash guard positioned within said chamber cavity for substantially preventing erosion of a bottom surface of said chamber cavity by a flow of effluent.

6. The aggregate chamber of claim 1, wherein said first periphery comprises an upper periphery of said chamber cavity.

7. The aggregate chamber of claim 1, further comprising at least one support member positioned within said chamber cavity to support said at least one panel.

8. The aggregate chamber of claim 7, wherein said at least one support member comprises at least one opening for allowing effluent to flow therethrough.

9. The aggregate chamber of claim 1, wherein said chamber cavity has a fourth periphery defined by a lower surface of a trench excavated in the leach field.

10. The aggregate chamber of claim 1, wherein said first periphery comprises an upper periphery of said chamber cavity and wherein said panel comprises an arched shape.

11. The aggregate chamber of claim 1, wherein said panel further comprises at least two downwardly sloping surfaces and said first periphery defines an upper periphery of said chamber cavity.

12. The aggregate chamber of claim 1, further comprising at least one end set at a predetermined angle relative to a longitudinal dimension of said chamber to thereby allow for connecting a plurality of chambers to each other so as to form a chamber leach line having a bend therein.

13. An aggregate chamber for leaching effluent into a leach field, comprising:

a plurality of foldingly connected panels positioned to define up to three peripheries of a chamber cavity for therein receiving effluent for leaching and at least one conduit positioned to deliver effluent to said chamber cavity, said conduit sharing at least one water permeable periphery with said chamber; and a particulate aggregate positioned in said conduit so as to filter the effluent during delivery to said chamber through said water permeable periphery.

14. The chamber unit of claim 13, wherein said effluent comprises septic tank effluent.

15. The chamber unit of claim 13, wherein said aggregate comprises a lightweight particulate material.

16. The chamber unit of claim 13, wherein said aggregate comprises a material selected from expanded polystyrene, polyethylene, polyurethane, polypropylene, and rubber chips.

17. The chamber unit of claim 13, further comprising an opening into said chamber cavity for therethrough making a fluid connection with a source of effluent.

18. The chamber unit of claim 13, further comprising a splash guard positioned within said chamber cavity for substantially preventing erosion of a lower periphery of said chamber cavity by a flow of effluent.

19. The chamber unit of claim 13, wherein said plurality of foldingly connected panels further comprises at least one support member positioned to support an upper periphery of said chamber cavity.

20. The chamber unit of claim 13, wherein said aggregate is substantially contained within a water permeable material.

21. The chamber unit of claim 20, wherein said water permeable material comprises a mesh.

22. The chamber unit of claim 13, further comprising a trench excavated in said leach field, wherein said trench comprises a lower periphery of said chamber cavity.

23. The chamber unit of claim 13, wherein said conduit comprises a performated conduit.

24. The chamber unit of claim 13, wherein at least one individual panel of said plurality of panels is positioned to define an upper periphery of said chamber cavity having an arched shape.

25. The chamber unit of claim 13, wherein at least one individual panel of said plurality of panels is positioned to define an upper periphery of said chamber having two downwardly sloping surfaces.

26. The chamber unit of claim 13, further comprising at least one end of said chamber unit set at a predetermined angle relative to a longitudinal dimension of said chamber for connecting a plurality of chambers so as to form a chamber leach line having a bend therein.

27. A chamber leach line for leaching effluent in a leach field,, comprising:

at least one trench excavated in the leach field; and at least one chamber unit connected in fluid connection with a source of effluent and positioned in said trench for leaching the effluent to the soil;

wherein said chamber unit comprises a cavity for therein receiving the effluent for leaching, at least one panel positioned along a periphery of said cavity, and positioned adjacent said panel a plurality of aggregate drainage lines, each drainage line of the plurality having a perforated conduit and a lightweight aggregate substantially contained within a water permeable material for filtering effluent, wherein said plurality of aggregate drainage lines comprises lateral peripheries of said chamber unit.

28. The leach line of claim 27, wherein individual chamber units of said plurality of chamber units are pivotally connected to each other so as to form a chamber leach line comprising a bend.

29. The leach line of claim 27, wherein individual chamber units of said plurality of chamber units further comprise at least one end set at a predetermined angle relative to a longitudinal dimension of said chamber unit to thereby allow for connecting a plurality of chamber units to each other so as to form a leach line having a bend therein.

30. The leach line of claim 27, wherein said effluent comprises septic tank effluent.

31. The leach line of claim 27, wherein said effluent comprises stormwater runoff.

32. The leach line of claim 27, wherein said aggregate comprises a lightweight particulate material.

33. The leach line of claim 27, wherein said aggregate comprises a material selected from expanded polystyrene, polyethylene, polyurethane, polypropylene, and rubber chips.

34. The leach line of claim 27, wherein said water permeable material comprises a mesh.

35. A leach field for leaching effluent into soil, comprising:

a source of effluent;

at least one trench excavated in the soil adjacent said source of effluent; and at least one leach line positioned in said trench in fluid connection with said source of effluent for distributing the effluent by leaching into the leach field;

wherein said leach line includes at least one chamber unit comprising a chamber cavity for therein receiving the effluent for leaching, at least one panel positioned along a periphery of said chamber cavity, and a plurality of prefabricated drainage lines having a water permeable material substantially surrounding a perforated conduit and a lightweight aggregate, said plurality of drainage lines positioned adjacent said panel for filtering effluent, wherein said plurality of prefabricated drainage lines comprises a lateral periphery of said chamber cavity.

36. The leach field of claim 35, further comprising a plurality of chamber units pivotally connected to each other so as to form a leach line forming a bend.

37. The leach field of claim 35, further comprising a plurality of chamber units each having at least one end set at a predetermined angle relative to a longitudinal dimension of the chamber unit to thereby allow for connecting a plurality of chamber units to each other so as to form a bend in the leach line.

38. The leach field of claim 35, wherein said source of effluent comprises a septic tank.

39. The leach field of claim 35, wherein said source of effluent comprises stormwater runoff.

40. The leach field of claim 35, wherein said aggregate comprises a lightweight particulate material.

41. The leach field of claim 35, wherein said aggregate comprises a material selected from expanded polystyrene, polyethylene, polyurethane, polypropylene, and rubber chips.

42. The leach field of claim 35, wherein said water permeable material comprises a mesh.

* * * * *